US008851600B2

(12) United States Patent
Nagashima

(10) Patent No.: US 8,851,600 B2
(45) Date of Patent: Oct. 7, 2014

(54) INKJET RECORDING APPARATUS AND METHOD

(75) Inventor: Kanji Nagashima, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 274 days.

(21) Appl. No.: 13/137,575

(22) Filed: Aug. 26, 2011

(65) Prior Publication Data

US 2012/0050363 A1 Mar. 1, 2012

(30) Foreign Application Priority Data

Aug. 27, 2010 (JP) ..... 2010-190933

(51) Int. Cl.

| | |
|---|---|
| ***B41J 29/38*** | (2006.01) |
| ***B41J 2/045*** | (2006.01) |
| ***B41J 11/00*** | (2006.01) |
| ***B41J 11/42*** | (2006.01) |

(52) U.S. Cl.

CPC ..... *B41J 2/04508* (2013.01); *B41J 2/04588* (2013.01); *B41J 2/0459* (2013.01); *B41J 11/008* (2013.01); *B41J 2/04593* (2013.01); *B41J 2/04591* (2013.01); *B41J 2/04581* (2013.01); *B41J 2/0458* (2013.01); *B41J 2/04595* (2013.01); *B41J 11/42* (2013.01); *B41J 2202/21* (2013.01)

USPC ..... 347/10

(58) Field of Classification Search

CPC . B41J 2/04508; B41J 2/04593; B41J 2/04595
See application file for complete search history.

(56) References Cited

U.S. PATENT DOCUMENTS

| | | | | |
|---|---|---|---|---|
| 7,658,461 | B2 * | 2/2010 | Ito | 347/17 |
| 2004/0189728 | A1 * | 9/2004 | Nakajima | 347/14 |
| 2006/0132517 | A1 * | 6/2006 | Vinas | 347/9 |
| 2006/0170716 | A1 * | 8/2006 | Reyero et al. | 347/5 |

FOREIGN PATENT DOCUMENTS

| | | | | |
|---|---|---|---|---|
| JP | 036447 | * | 8/2008 | B41J 3/04 |
| JP | 2010-36447 A | | 2/2010 | |
| JP | 2010036447 A | * | 2/2010 | |

OTHER PUBLICATIONS

Machine generated English translation of JP 2010-036447A to Mitsuki, "Printer and Printing Method"; generated via http://www19.ipdl.inpit.go.jp/PA1/cgi-bin/PA1INIT?1390399776539 on Jan. 14, 2014; 17pp.*

Japanese Office Action issued in Japanese Application No. 2010-190933 on Jan. 7, 2014 along with a partial English Translation thereof.

Japanese Office Action issued in Japanese Application No. 2010-190933 on Jul. 22, 2014 along with a partial English Translation thereof.

* cited by examiner

*Primary Examiner* — Matthew Luu
*Assistant Examiner* — Tracey McMillion
(74) *Attorney, Agent, or Firm* — Birch, Stewart, Kolasch & Birch, LLP

(57) ABSTRACT

An inkjet recording apparatus includes: a paper conveying device which conveys paper; a line-type inkjet head which performs image formation on the paper by ejecting ink droplets to the paper conveyed by the paper conveying device; a paper conveyance speed measuring device which measures a paper conveyance speed of the paper at the image formation by the inkjet head; a dot arrangement data acquiring device which acquires data for arranging dots to form an image by the inkjet head on the paper conveyed at a predetermined paper conveyance speed; a dot arrangement data adjusting device which adjusts the data for arranging dots in accordance with the paper conveyance speed measured by the paper conveyance speed measuring device so that the image is formed on the paper with a constant image density even when the paper conveyance speed varies; and a head drive controlling device which controls drive of the inkjet head in accordance with the adjusted data for arranging dots.

15 Claims, 18 Drawing Sheets

(a)

SMALL SIZE (b)

MEDIUM SIZE (c)

LARGE SIZE (a)

(b)

INKJET RECORDING APPARATUS AND METHOD

BACKGROUND OF THE INVENTION

1. Field of the Invention

The present invention relates to an inkjet recording apparatus and an inkjet recording method, and more particularly to an inkjet recording apparatus and an inkjet recording method for forming an image on a running continuous paper (web) in band form with a line-type inkjet head.

2. Description of the Related Art

In an inkjet recording apparatus for printing on paper while unwinding the paper from a paper roll (paper web wound in a roll), a large amount of paper is wasted if printing begins after waiting until the speed at which the paper is conveyed (hereinafter referred to as the "paper conveyance speed") becomes constant, and therefore it is required to print even while the paper conveyance speed is accelerating or decelerating.

In the related art, the paper conveyance speed is measured while printing so that the temporal intervals of ejections of ink droplets from the inkjet head are controlled in accordance with the paper conveyance speed, and thereby printing is made possible while the paper conveyance speed is accelerating or decelerating. When the ejection intervals of ink droplets are varied in this manner during printing, however, such a problem arises that the density of the formed image becomes uneven.

Japanese Patent Application Publication No. 2010-036447 discloses that the ejection amounts of ink droplets are controlled to always be constant under the assumption that the cause of the image density being uneven is the variation of the ejection amounts accompanying the variation of the ejection intervals.

SUMMARY OF THE INVENTION

However, the cause of the image density variation is the variation in the interference between the deposited ink droplets accompanying the variation of the ejection intervals, and there is a problem that the image density variation cannot completely be corrected even when the ink droplets are ejected in a constant amount. More specifically, in the case of the inkjet system, the interference between the ink droplets landing on the paper varies when the ejection intervals vary, and thus the forms of the deposited ink droplets vary in such a manner that the image density varies macroscopically even when the same amounts of ink droplets are deposited. Moreover, the ink droplets that are to form a plurality of dots may combine together to form a large dot, and thereby such a problem arises that the formation of the dots is lost.

The present invention has been contrived in view of these circumstances, an object thereof being to provide an inkjet recording apparatus and an inkjet recording method with which a high quality image with even density can be formed while the paper is accelerating or decelerating.

In order to attain the aforementioned object, the present invention is directed to an inkjet recording apparatus, comprising: a paper conveying device which conveys paper; a line-type inkjet head which performs image formation on the paper by ejecting ink droplets to the paper conveyed by the paper conveying device; a paper conveyance speed measuring device which measures a paper conveyance speed of the paper at the image formation by the inkjet head; a dot arrangement data acquiring device which acquires data for arranging dots to form an image by the inkjet head on the paper conveyed at a predetermined paper conveyance speed; a dot arrangement data adjusting device which adjusts the data for arranging dots in accordance with the paper conveyance speed measured by the paper conveyance speed measuring device so that the image is formed on the paper with a constant image density even when the paper conveyance speed varies; and a head drive controlling device which controls drive of the inkjet head in accordance with the adjusted data for arranging dots.

According to this aspect of the present invention, the data for arranging dots is adjusted in accordance with the paper conveyance speed so that an image can be formed with a constant image density even when the paper conveyance speed varies. Thus, a high quality image with a constant image density can be formed even when the paper conveyance speed is accelerated or decelerated.

Preferably, the inkjet recording apparatus further comprises: an adjustment information storing device which stores adjustment information for the data for arranging dots for each paper conveyance speed, wherein the dot arrangement data adjusting device adjusts the data for arranging dots in accordance with the adjustment information stored in the adjustment information storing device.

According to this aspect of the present invention, the data for arranging dots is adjusted in accordance with the adjustment information preset for each paper conveyance speed. The adjustment information is acquired as the conditions for correcting the difference between the density of the image that is measured when the paper is conveyed at a predetermined speed and the density of the image that is measured when the paper is conveyed at a different speed. Thus, the data for arranging dots can be easily adjusted.

Preferably, the adjustment information is information on a gradation curve which represents a relationship between a density of an input image and an appearance rate of dots for each paper conveyance speed.

According to this aspect of the present invention, the adjustment information is set as the information on the gradation curve that represents the relationship between the density of the input image and the appearance rate of dots for each paper conveyance speed. More specifically, the data for arranging dots can be adjusted by altering the appearance rate of dots.

Preferably, the gradation curve is set in such a manner that the appearance rate of dots of a small size increases as the paper conveyance speed increases, while the appearance rate of dots of a large size increases as the paper conveyance speed decreases.

According to this aspect of the present invention, the gradation curve is set for each paper conveyance speed in such a manner that the appearance rate of dots of a small size increases as the paper conveyance speed increases, while the appearance rate of dots of a large size increases as the paper conveyance speed decreases. More specifically, the higher the paper conveyance speed is, the easier it is for the landing ink droplets to interfere with each other, and therefore the rate of dots of the small size is increased as the paper conveyance speed is higher so that the possibility of the interference between the landed droplets is lowered. On the other hand, it is difficult for the landed droplets to interfere with each other when the paper conveyance speed is low, and therefore the appearance rate of dots of the large size is increased so that the load applied to the inkjet head is reduced.

Preferably, in a case where there is no information on the gradation curve corresponding to the paper conveyance speed measured by the paper conveyance speed measuring device, the dot arrangement data adjusting device adjusts the data for arranging dots in accordance with the information on the gradation curve corresponding to the paper conveyance speed near the measured paper conveyance speed.

According to this aspect of the present invention, in the case where there is no information on the gradation curve corresponding to the measured paper conveyance speed, the data for arranging dots is adjusted in accordance with the information on the gradation curve corresponding to the paper conveyance speed near the measured paper conveyance speed. Thereby, the data for arranging dots can be appropriately adjusted even when the information on the gradation curve corresponding to all the paper conveyance speeds is not stored. Thus, the adjustment information storing device can be efficiently used.

Preferably, the dot arrangement data adjusting device adjusts the data for arranging dots for a region having an image density which is not lower than a predetermined value.

According to this aspect of the present invention, only the data for arranging dots in the region having the predetermined or higher image density can be adjusted. More specifically, the region having a low image density has a lower possibility of interference between the deposited ink droplets because the positional interval between the deposited ink droplets is large, and therefore the image density does not vary even when the image is formed using the original data for arranging dots. This can be done well only with the adjustment of necessary regions, and therefore the processing rate of adjustment can be increased. Preferably, the dot arrangement data adjusting device adjusts the data for arranging dots for a region where the dots are arranged adjacently to each other.

According to this aspect of the present invention, only the data for arranging dots in the region where the dots are arranged adjacently to each other is adjusted. More specifically, it is easy for the deposited droplets to interfere with each other in the region where the ink droplets are deposited to form the dots adjacent to each other, while it is difficult for the deposited droplets to interfere with each other in a region where the ink droplets are deposited to form the dots scattered, and therefore, in order to prevent the unevenness in the image density, it is sufficient to adjust only the data for arranging dots in the region where the ink droplets are deposited to form the dots adjacent to each other. Thereby, only the necessary regions are adjusted, and thus the processing rate of adjustment can be increased.

Preferably, the dot arrangement data adjusting device adjusts the data for arranging dots for the region where the dots are arranged so as to surround one dot by four or eight adjacent dots that are arranged above, below, right and left of the one dot.

According to this aspect of the present invention, the data for arranging dots is adjusted in the region where the ink droplets are deposited to form the dots arranged so as to surround one dot by four or eight adjacent dots that are arranged above, below, right and left of the one dot.

Preferably, the dot arrangement data adjusting device adjusts the data for arranging dots in accordance with an average paper conveyance speed in a case where a variation in the paper conveyance speed when one image is formed is not larger than a first threshold value.

According to this aspect of the present invention, in the case where the amount of variation in the paper conveyance speed is small, the data for arranging dots is adjusted in accordance with the average paper conveyance speed. When the paper conveyance speed varies slowly (for example, is slowly accelerated or decelerated), the amount of variation in the image density is also small, and therefore the data for arranging dots is adjusted for the average paper conveyance speed. Thus, it is not necessary to adjust the data for arranging dots every time and the images can be formed efficiently.

Preferably, the dot arrangement data adjusting device adjusts the data for arranging dots in accordance with an average paper conveyance speed for a plurality of images in a case where a variation in the paper conveyance speed when one image is formed is not larger than a second threshold value smaller than the first threshold value.

According to this aspect of the present invention, in the case where the amount of variation in the paper conveyance speed is very small (for example, is very slowly accelerated or decelerated), the data for arranging dots is adjusted in accordance with the average paper conveyance speed when a plurality of images is formed. Thus, the images can be formed more efficiently.

Preferably, the paper is continuous paper in band form; and the paper conveying device feeds out the paper that is wound on a core in a roll, makes the paper run through a predetermined conveyance path, and winds up the paper on a core in a roll.

According to this aspect of the present invention, the image is formed on continuous paper in band form. It is necessary to form the image while the feeding of the continuous paper in band form is accelerated or decelerated in order to prevent the paper from being wasted, and this aspect of the present invention makes it possible to form a high quality image with even image density even when the feeding of the paper is accelerated or decelerated.

In order to attain the aforementioned object, the present invention is also directed to an inkjet recording apparatus, comprising: a paper conveying device which conveys paper; a line-type inkjet head which performs image formation on the paper by ejecting ink droplets to the paper conveyed by the paper conveying device; a paper conveyance speed measuring device which measures a paper conveyance speed of the paper at the image formation by the inkjet head; a dot arrangement data acquiring device which acquires data for arranging dots to form an image by the inkjet head on the paper conveyed at a predetermined paper conveyance speed; an ejection amount information storing device which stores information on an ejection amount of ink per dot when an image is formed on the paper conveyed at a predetermined paper conveyance speed; an adjustment information storing device which stores, for each paper conveyance speed, adjustment information for the ejection amount used to form an image with a constant image density on the paper even when the paper conveyance speed varies; an ejection amount adjusting device which adjusts the ejection amount in accordance with the paper conveyance speed measured by the paper conveyance speed measuring device; and a head drive controlling device which controls drive of the inkjet head in accordance with the information on the adjusted ejection amount and the data for arranging dots.

According to this aspect of the present invention, the amount of ink ejected per dot can be adjusted in accordance with the paper conveyance speed so that the image can be formed with a constant image density even when the paper conveyance speed varies. Thus, a high quality image with even image density can be formed even when the paper is accelerated or decelerated.

Preferably, in a case where there is no adjustment information for the ejection amount corresponding to the paper conveyance speed measured by the paper conveyance speed measuring device, the ejection amount adjusting device adjusts the ejection amount in accordance with the adjustment information for the ejection amount corresponding to the paper conveyance speed near the measured paper conveyance speed.

According to this aspect of the present invention, in the case where there is no adjustment information of the ejection amount corresponding to the measured paper conveyance speed, the ejection amount is adjusted in accordance with the adjustment information corresponding to the paper conveyance speed near the measured paper conveyance speed. Thereby, the ejection amount can be adjusted appropriately without having adjustment information corresponding to all of the paper conveyance speeds. Thus, the adjustment information storing device can be used efficiently.

Preferably, the information on the ejection amount of ink is information on a waveform of a drive signal applied to an actuator in the inkjet head, and the adjustment information is information for altering at least one of a peak value and a pulse width of the waveform of the drive signal.

According to this aspect of the present invention, the information on the ejection amount of ink is defined as the waveform information of the drive signal applied to the actuator of the inkjet head, and the ejection amount of ink per dot is adjusted by altering the peak value and/or the pulse width of the waveform of the drive signal.

Preferably, the ejection amount adjusting device adjusts the ejection amount for a region having an image density which is not lower than a predetermined value.

According to this aspect of the present invention, the ejection amount is adjusted only in the region having the predetermined or higher image density. More specifically, the region having the low image density has a low possibility of interference between the deposited droplets because the positional interval between the deposited droplets is large, and therefore the image density does not vary even when the image is formed with the original ejection amount. This can be done well only with adjusting the ejection amount in the necessary regions, and thus the processing rate of adjustment can be increased.

Preferably, the ejection amount adjusting device adjusts the ejection amount for a region where the dots are arranged adjacently to each other.

According to this aspect of the present invention, the ejection amount only in the region where the ink droplets are deposited to form the dots adjacent to each other is adjusted. More specifically, it is easy for the deposited ink droplets to interfere with each other in a region where the ink droplets are deposited to form the dots adjacent to each other, while it is difficult for the deposited ink droplets to interfere with each other in the region where the ink droplets are deposited to form the dots scattered, and therefore, in order to prevent the unevenness in the image density, it is sufficient to adjust the ejection amount only in the region where the ink droplets are deposited to form the dots adjacent to each other. The ejection amount only in the necessary regions is adjusted, and thus the processing rate of adjustment can be increased.

Preferably, the ejection amount adjusting device adjusts the ejection amount for the region where the dots are arranged so as to surround one dot by four or eight adjacent dots that are arranged above, below, right and left of the one dot.

According to this aspect of the present invention, the ejection amount is adjusted in the region where the ink droplets are deposited to form the dots arranged so as to surround one dot by four or eight adjacent dots that are arranged above, below, right and left of the one dot.

Preferably, the ejection amount adjusting device adjusts the ejection amount in accordance with an average paper conveyance speed in a case where a variation in the paper conveyance speed when one image is formed is not larger than a first threshold value.

According to this aspect of the present invention, in the case where the amount of variation in the paper conveyance speed is small, the ejection amount is adjusted in accordance with the average paper conveyance speed. When the paper conveyance speed varies slowly, the amount of variation in the image density is also small, and therefore the ejection amount is adjusted for the average paper conveyance speed. Thus, it is not necessary to adjust the ejection amount every time, and the image can be formed efficiently.

Preferably, the ejection amount adjusting device adjusts the ejection amount in accordance with an average paper conveyance speed for a plurality of images in a case where a variation in the paper conveyance speed when one image is formed is not larger than a second threshold value smaller than the first threshold value.

According to this aspect of the present invention, in the case where the amount of variation in the paper conveyance speed is very small, the ejection amount is adjusted in accordance with the average paper conveyance speed when a plurality of images is formed. Thus, the image can be formed more efficiently.

Preferably, the paper is continuous paper in band form; and the paper conveying device feeds out the paper that is wound on a core in a roll, makes the paper run through a predetermined conveyance path, and winds up the paper on a core in a roll.

According to this aspect of the present invention, the image is formed on continuous paper in band form. It is necessary to form the image while the feeding of the continuous paper in band form is accelerated or decelerated in order to prevent the paper from being wasted, and this aspect of the present invention makes it possible to form a high quality image with even image density even when the feeding of the paper is accelerated or decelerated.

In order to attain the aforementioned object, the present invention is also directed to an inkjet recording method of performing image formation on running paper by ejecting ink droplets to the paper from a line-type inkjet head, the method comprising the steps of: acquiring in advance adjustment conditions for adjusting data for arranging dots, the adjustment conditions being used to correct a variation in image density occurring in an image formed on the paper when the paper runs at a speed other than a predetermined speed; adjusting the data for arranging dots for an image to be formed in accordance with the adjustment conditions in a case where the paper runs at a speed other than the predetermined speed; driving the inkjet head in accordance with the adjusted data for arranging dots; and forming the image on the paper.

According to this aspect of the present invention, the adjustment conditions for adjusting the data for arranging dots are acquired in advance in order to prevent the variation in the density of the image formed on paper when the paper is conveyed at a speed other than the predetermined speed. In the case where the paper is conveyed at a speed other than the predetermined speed, the data for arranging dots in the image to be formed is adjusted in accordance with the adjustment conditions, and then the image is formed. Thus, a high quality image with even image density can be formed even when the feeding of the paper is accelerated or decelerated.

Preferably, the paper is continuous paper in band form.

According to this aspect of the present invention, the image is formed on continuous paper in band form. It is necessary to form the image while the feeding of the continuous paper in band form is accelerated or decelerated in order to prevent the paper from being wasted, and this aspect of the present invention makes it possible to form a high quality image with even image density even when the feeding of the paper is accelerated or decelerated.

In order to attain the aforementioned object, the present invention is also directed to an inkjet recording method of performing image formation on running paper by ejecting ink droplets to the paper from a line-type inkjet head, the method comprising the steps of: acquiring in advance adjustment conditions for adjusting an ejection amount of ink per dot, the adjustment conditions being used to correct a variation in image density occurring in an image formed on the paper when the paper runs at a speed other than a predetermined speed; adjusting the ejection amount of ink per dot in accordance with the adjustment conditions in a case where the paper runs at a speed other than the predetermined speed; driving the inkjet head so that ink droplets of the adjusted amount are ejected; and forming the image on the paper.

According to this aspect of the present invention, the adjustment conditions for adjusting the ejection amount of ink per dot are acquired in advance in order to prevent the variation in the density of the image formed on paper when the paper is conveyed at a speed other than the predetermined speed. In the case where the paper is conveyed at a speed other than the predetermined speed, the ejection amount of ink per dot is adjusted in accordance with the adjustment conditions, and then the image is formed while the ink droplets are ejected in the adjusted amount. Thus, a high quality image with even image density can be formed even when the feeding of the paper is accelerated or decelerated.

Preferably, the ejection amount of ink per dot is adjusted by altering at least one of a peak value and a pulse width of a waveform of a drive signal applied to an actuator in the inkjet head According to this aspect of the present invention, the ejection amount of ink per dot is adjusted by altering the peak value and/or the pulse width of the waveform of the drive signal applied to the actuator of the inkjet head.

Preferably, the paper is continuous paper in band form.

According to this aspect of the present invention, the image is formed on continuous paper in band form. It is necessary to form the image while the feeding of the continuous paper in band form is accelerated or decelerated in order to prevent the paper from being wasted, and this aspect of the present invention makes it possible to form a high quality image with even density even when the feeding of the paper is accelerated or decelerated.

According to the present invention, it is possible to form a high quality image with even image density even when the feeding of the paper is accelerated or decelerated.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Here, an embodiment is described of a case where the present invention is applied to an inkjet printer for printing an image on continuous paper in band form (web) using water-based ink by means of an inkjet system.

Structure of Inkjet Printer

Figure 1:
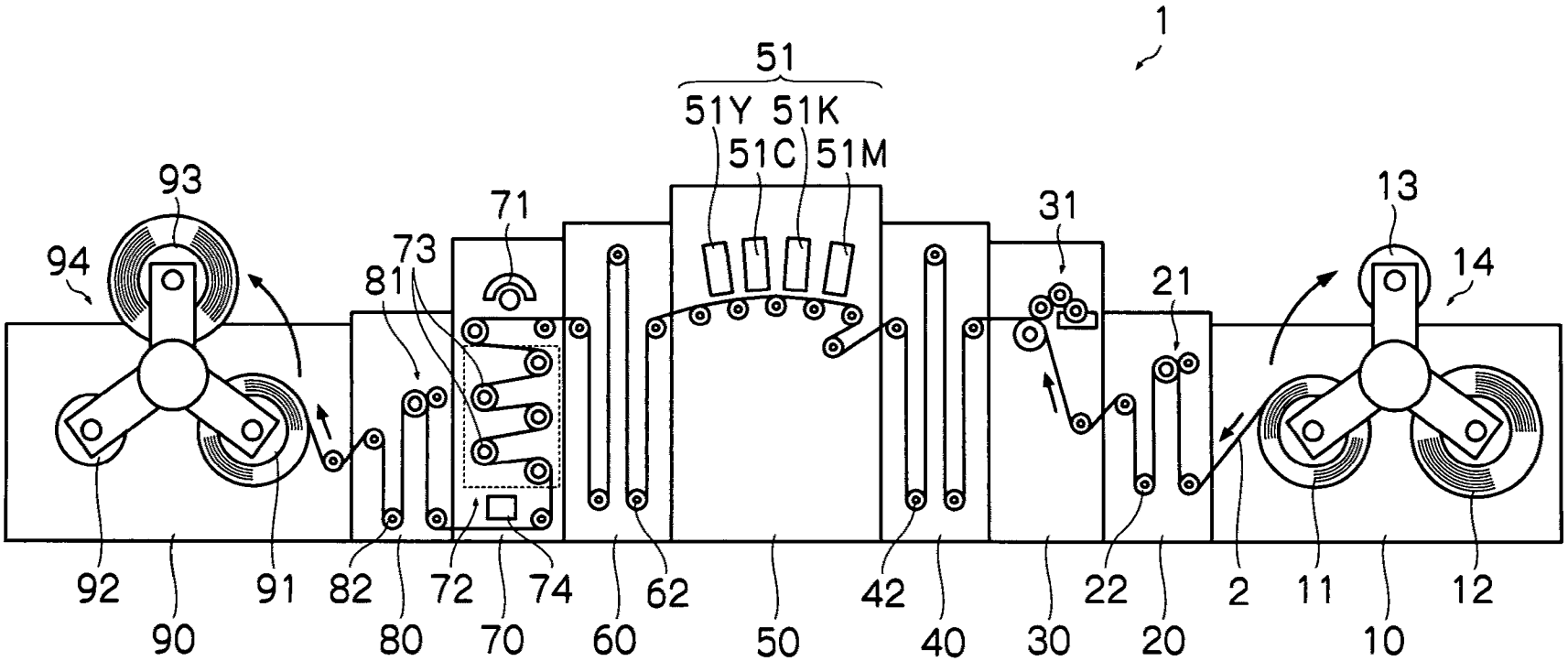
FIG. 1 is a diagram showing the entire structure of an inkjet printer.

FIG. 1 is a diagram showing the entire structure of an inkjet printer 1. The inkjet printer 1 includes: a web supplying unit 10, which supplies a web 2; an in-feed unit 20, which feeds the web 2; a treatment liquid applying unit 30, which applies a predetermined treatment liquid to the printing surface of the web 2; a first drying unit 40, which dries the web 2 on which the treatment liquid has been applied; a printing unit 50, which forms an image on the web 2; a second drying unit 60, which dries the web 2 on which the image has been formed; a fixing and reading unit 70, which fixes the image formed on the web 2 and reads the formed image; an out-feed unit 80, which feeds the web 2; and a web collecting unit 90, which winds up the web 2.

The web 2 supplied from the web supplying unit 10 is fed by the in-feed unit 20 and the out-feed unit 80 so as to run through a predetermined conveyance path so that predetermined treatments are carried out in the treatment liquid applying unit 30, the first drying unit 40, the printing unit 50, the second drying unit 60, and the fixing and reading unit 70 that are installed along the conveyance path, and then the web 2 is wound in the web collecting unit 90.

<Web>

The web 2, which is a recording medium, is wound on a core in a roll, and is installed in a state of the web roll to the web supplying unit 10. The type of web 2 is not particularly limited, and general printing paper (paper having cellulose as its main component, for example, so-called high quality paper, coated paper and art paper, which are used in general offset printing) can be used in the inkjet printer 1 according to the present embodiment.

<Web Supplying Unit>

The web supplying unit 10 continuously supplies the web 2. The web supplying unit 10 includes: a reel stand 14, on which the web rolls are installed; and a web connecting device (not shown), which connects a new web to a previous web when the previous web roll is replaced with the new one.

The reel stand 14 is formed so that a plurality of web rolls can be installed, and automatically switches the web rolls for supplying the web 2. The reel stand 14 in the present embodiment has three arms radially extending, and each of the three arms has a web roll installing unit. Accordingly, three web rolls can be installed simultaneously. The three arms rotate when driven by a motor (not shown) so that the locations of the web rolls are switched. When the locations of the web rolls are switched in this manner, the web roll for supplying the web 2 is replaced. Here, in FIG. 1, reference numeral 11 denotes the web roll that is supplying the web 2, reference numeral 12 denotes the web roll that is to supply the web next, and reference numeral 13 denotes the web roll that has been used. The three arms rotate clockwise in FIG. 1 in order to replace the web roll for supplying the web 2. Each web roll installing unit is provided with a motor (not shown), and the web roll installed in each unit rotates when driven by the motor.

When the previous and new web rolls are switched, the web connecting device (not shown) connects a new web to the previous web. More specifically, the leading end of the web 2 that is unwound from the web roll 12 to be used next is connected to the web 2 that has been unwound from the web roll 11 in use so as to provide the continuous web 2. Thus, the web 2 can be supplied continuously.

The previous and new rolls are switched as follows. First, the arms of the reel stand 14 are rotated so that the new web roll 12 approaches the line along which the web 2 is running. Next, the circumferential speed of the new web roll 12 is matched with the speed at which the web 2 is conveyed. Next, the web connecting device (not shown) is operated so that the web 2 is drawn out from the new web roll 12 and is connected to the web 2 that has been drawn out from the web roll 11 in use. Here, the leading end of the web 2 that is drawn out from the new web roll 12 has a margin for gluing, and the web connecting device presses this margin for gluing to the web 2 that has been drawn out from the web roll 11 in use so that the previous and new webs are connected (making web connection). After the connection, the web connecting device cuts the web 2 that is being drawn out from the web roll 11 in use with a cutter so as to be separated from the newly connected web 2. Thus, the previous and new web rolls are switched.

Here, the previous and new web rolls are automatically switched. More specifically, the remaining amount of the web 2 is measured by a remaining amount measuring device (not shown) so that the web roll is replaced with a new web roll just before the web 2 runs out.

<In-Feed Unit>

The in-feed unit 20 draws the web 2 out from the web roll in the web supplying unit 10 and feeds the drawn web 2 toward the printing unit 50. The in-feed unit 20 includes: a pair of in-feed rollers 21, which nip and feed the web 2; and a dancer roller 22, which adjusts the tension of the web 2.

The pair of in-feed rollers 21 rotate when driven by a motor (not shown). The rotational speed of the pair of in-feed rollers 21 can be set to an arbitrary value, and the feeding speed of the web 2 is adjusted by adjusting the rotational speed of the pair of in-feed rollers 21.

The dancer roller 22 is swing ably held by an actuator (not shown). The tension of the running web 2 is adjusted by the dancer roller 22. When the web roll is replaced, the web 2 is temporarily stored by the dancer roller 22 so as to secure the time necessary for connecting the web. Moreover, in the case where the conveyance speed of the web 2 is changed, the variation of the tension is cancelled by the dancer roller 22.

<Treatment Liquid Applying Unit>

The treatment liquid applying unit 30 applies the predetermined treatment liquid to the printing surface of the web 2. As described above, the inkjet printer 1 in the present embodiment prints an image on general printing paper using the water-based ink by means of the inkjet system. When an image is printed on general printing paper having cellulose as the main component using the water-based ink by means of the inkjet system, the ink (coloring material) easily moves after the ink droplets have landed on the printing surface, and thereby the quality of the image easily deteriorates. Therefore, the inkjet printer 1 in the present embodiment beforehand applies the treatment liquid, which induces an aggregation reaction with the ink of which the droplets are deposited in the printing unit 50, to the printing surface of the web 2. By applying the treatment liquid inducing the aggregation reaction with the ink and subsequently depositing the ink droplets, the smearing and interference between the ink droplets as well as a mixing of colors (combining of the ink droplets) after the ink droplets have landed can be prevented, and thus a high quality image can be formed.

The treatment liquid applying unit 30 includes a treatment liquid applying device 31, which applies the treatment liquid to the printing surface of the running web 2. The treatment liquid applying device 31 presses an application roller, to which the treatment liquid has been applied to the surface, against the printing surface of the web 2 so that the treatment liquid is applied to the printing surface of the web 2 so as to have a constant thickness.

Here, the structure of the treatment liquid applying device is not limited to this, and the structure for using a line-type inkjet head to apply the treatment liquid and the structure for spraying the treatment liquid to be applied, for example, are possible.

The treatment liquid contains an aggregating agent for aggregating a component in the ink composition. The aggregating agent may be a compound that can change the pH in the ink composition, a multivalent metal salt or a polyallylamine. Preferable examples of the compound that can lower the pH include acidic substances that are highly water-soluble (e.g., phosphoric acid, oxalic acid, malonic acid, citric acid, derivatives of these compounds or salts of these). The acidic substances may be solely used or two or more acidic substances may be used together. As a result, the aggregability is increased so that the entirety of the ink can be fixed. In addition, it is preferable for the pH of the ink composition (at 25° C.) to be 8.0 or higher and for the pH of the treatment liquid (at 25° C.) to be in a range from 0.5 to 4. As a result, the density of the image, the resolution and the speed of inkjet recording can be increased. In addition, the treatment liquid may contain additives. The treatment liquid may contain known additives such as anti-drying agents (moistening agents), anti-fading agents, emulsion stabilizers, permeation accelerating agents, ultraviolet ray absorbing agents, antiseptic agents, mildew-proofing agents, pH regulators, surface tension regulators, anti-foaming agents, viscosity regulators, dispersing agents, dispersing stabilizers, rust inhibitors and chelating agents.

<First Drying Unit>

The first drying unit 40 dries the treatment liquid that has been applied on the web 2. The first drying unit 40 includes a dryer (not shown), which blows hot air against the printing surface of the running web 2 so that the web 2 is heated and dried.

The first drying unit 40 further includes a dancer roller 42 in order to temporarily store the web 2, which is necessary for the web connection and for dealing with the variation in the conveyance speed of the web 2. The dancer roller 42 is swing ably held by an actuator (not shown), and adjusts the tension of the running web 2.

<Printing Unit>

The printing unit 50 ejects and deposits droplets of ink of different colors such as magenta (M), black (K), cyan (C) and yellow (Y), from the inkjet heads 51 (51M, 51K, 51C, 51Y) onto the printing surface of the running web 2 so as to form a color image. The printing unit 50 includes the inkjet head 51M for ejecting magenta ink droplets, the inkjet head 51K for ejecting black ink droplets, the inkjet head 51C for ejecting cyan ink droplets and the inkjet head 51Y for ejecting yellow ink droplets.

The inkjet head 51 for each color is formed as a line-type inkjet head corresponding to the width of the web 2 so that an image can be formed on the running web 2 in a single pass.

Here, the structure of the driving unit for ejecting ink droplets from the nozzles is not particularly limited. Droplets may be ejected by means of a thermal inkjet system using heating elements, or by means of a piezoelectric inkjet system using piezoelectric elements. The present embodiment uses an inkjet for ejecting ink droplets from nozzles by means of the piezoelectric inkjet system using piezoelectric elements.

The conveyance path of the web 2 in the printing unit 50 is in convex form that curves upward where a constant tension is applied to the web 2 in order to secure the clearance between the web 2 and the respective inkjet heads 51.

When the web 2 that runs through the printing unit 50 is passing through the image forming position directly below the inkjet heads, the speed (the web conveyance speed at the image formation) is measured by a mechanism (not shown) for measuring the web conveyance speed at the image formation.

The mechanism for measuring the web conveyance speed at the image formation includes a device, such as a rotary encoder, that is arranged around the axis of the roller for conveying the web 2 and measures the amount of rotation of the roller, so that the web conveyance speed at the image formation can be determined from the amount of rotation of the roller. Alternatively, a laser Doppler speed measurement device may be used to measure the web conveyance speed at the image formation. It is also possible that a pattern for measurement of the speed is printed in regions outside the printing range on the web 2 (for example, marginal portions on both sides of the web) so that the movement of this pattern can be measured by an optical sensor or the like, and thereby the web conveyance speed at the image formation can be determined.

The ink used in the inkjet printer 1 in the present embodiment is a water-based ultraviolet-curable ink, which contains a pigment, polymer particles and a water-soluble polymer compound that is polymerized by active energy rays. The water-based ultraviolet-curable ink is curable when irradiated with ultraviolet rays and has such properties that abrasion resistance is excellent and the film strength is high.

The used pigment is a water dispersing pigment where the surfaces of the pigment particles are at least partially coated with a polymer dispersing agent.

The used polymer dispersing agent is a polymer dispersing agent having an acid value of 25 to 1000 (KOH mg/g). This makes the stability for self-dispersion excellent and aggregability when making contact with the treatment liquid excellent.

The used polymer particles are self-dispersing polymer particles having an acid value of 20 to 50 (KOH mg/g). This makes the stability for self-dispersion excellent and aggregability when making contact with the treatment liquid excellent.

As for the polymer compound, a nonionic or cationic polymer compound is preferable in that the reaction between the aggregating agent and the pigment or the polymer particles is not prevented, and it is preferable to use a polymer compound having water solubility of 10 wt % or higher (more preferably, 15 wt % or higher).

The ink contains an initiator for starting the polymerization of the polymer compound when irradiated with active energy rays. The initiator may contain an appropriate compound which can initiate the polymerization reaction when irradiated with active energy rays, and an initiator (such as a photo polymerization initiator) which generates activated species (such as radicals, acids, and bases) when irradiated with radiation, light or an electron beam can be used. Here, the initiator may be contained in the treatment liquid, and it is sufficient that at least one of the ink and the treatment liquid contains the initiator.

The ink contains 50 wt % to 70 wt % of water. In addition, the ink may contain additives. The ink may contain known additives such as water-soluble organic solvents, anti-drying agents (moistening agents), anti-fading agents, emulsion stabilizers, permeation accelerating agents, ultraviolet ray absorbing agents, antiseptic agents, mildew-proofing agents, pH regulators, surface tension regulators, anti-foaming agents, viscosity regulators, dispersing agents, dispersing stabilizers, rust inhibitors and chelating agents.

<Second Drying Unit>

The second drying unit 60 dries the ink that has been deposited on the web 2. The second drying unit 60 includes a dryer (not shown), which blows hot air against the printing surface of the running web 2 so that the web 2 is heated and dried.

The second drying unit 60 further includes a dancer roller 62 in order to temporarily store the web 2, which is necessary for the web connection and for dealing with the variation in the conveyance speed of the web 2. The dancer roller 62 is swing ably held by an actuator (not shown), and adjusts the tension of the running web 2.

<Fixing and Reading Unit>

The fixing and reading unit 70 fixes the image that has been formed on the web 2, and reads out the formed image by means of a scanner 74. The fixing and reading unit 70 includes an ultraviolet ray irradiating source 71 for irradiating the printing surface of the web 2 on which the image has been formed with ultraviolet rays, a cooling device 72 for cooling the web 2, and the scanner 74 for reading out the formed image.

The ultraviolet ray irradiating source 71 irradiates the printing surface of the web 2 on which the formed image with ultraviolet rays so that the aggregated body of the treatment liquid and the ink is solidified.

The cooling device 72 includes a plurality of cooling rollers 73 that are cooled, and cools the web 2 to an appropriate temperature using these cooling rollers 73 so that the formed image is fixed.

The scanner 74 includes: a line CCD sensor, which is placed so as to be perpendicular to the direction in which the web 2 runs; an optical system, which forms an optical image on the line CCD sensor; and a light source. The scanner 74 reads out images formed on the running web 2 one after another. The image data acquired by the scanner 74 is outputted to a system controller 100, which controls the entire operation of the inkjet printer 1 (see FIG. 2). The system controller 100 analyzes the information acquired by the scanner 74 so as to detect an inappropriate ejection from the printing unit 50, a shift of deposition positions of the droplets or an inappropriate density of the formed image, in order to carry out necessary corrections and adjustments.

When the web 2 that runs through the fixing and reading unit 70 is passing through the reading unit having the scanner 74, the speed (the web conveyance speed at the image data acquisition) is measured by a mechanism (not shown) for measuring the web conveyance speed at the image data acquisition.

Similar to the mechanism for measuring the web conveyance speed at the image formation, the mechanism for measuring the web conveyance speed at the image data acquisition includes a device, such as a rotary encoder, that is arranged around the axis of the roller for conveying the web 2 and measures the amount of rotation of the roller, so that the web conveyance speed at the image data acquisition can be determined from the amount of rotation of the roller. Alternatively, a laser Doppler speed measurement device may be used to measure the web conveyance speed at the image data acquisition. It is also possible that a pattern for measurement of the speed is printed in regions outside the printing range on the web 2 (for example, marginal portions on both sides of the web) so that the movement of this pattern can be measured by an optical sensor or the like, and thereby the web conveyance speed at the image data acquisition can be determined.

The measured web conveyance speed at the image data acquisition can be used when analyzing the image data acquired by the scanner 74.

<Out-Feed Unit>

The out-feed unit 80 draws and feeds the web 2 toward the web collecting unit 90. The out-feed unit 80 includes: a pair of out-feed rollers 81, which nip and feed the web 2; and a dancer roller 82, which adjusts the tension of the web 2.

The pair of out-feed rollers 81 rotate when driven by a motor (not shown). The rotational speed of the pair of out-feed rollers 81 can be set to an arbitrary value, and the feeding speed of the web 2 is adjusted by adjusting the rotational speed of the pair of out-feed rollers 81.

The dancer roller 82 is swing ably held by an actuator (not shown). The tension of the running web 2 is adjusted by the dancer roller 82. When the core for rolling up the web 2 is replaced, the web 2 is temporarily stored by the dancer roller 82 so as to secure the time necessary for replacing the core. Moreover, in the case where the conveyance speed of the web 2 is changed, the variation of the tension is cancelled by the dancer roller 82.

<Web Collecting Unit>

The web collecting unit 90 winds the web 2 on which images have been formed onto a core. The web collecting unit 90 includes: a reel stand 94, on which the cores are installed; and a core connecting device (not shown), which connects an end of the web 2 to a new core when the previous core is replaced with the new core.

The reel stand 94 is formed so that a plurality of cores can be installed, and automatically switches the cores for winding up the web 2. The reel stand 94 in the present embodiment has three arms radially extending, and each of the three arms has a core installing unit. Accordingly, three cores can be installed simultaneously. The three arms rotate when driven by a motor (not shown) so that the locations of the cores are switched. When the locations of the cores are switched in this manner, the core for winding up the web 2 is replaced. Here, in FIG. 1, reference numeral 91 denotes the core onto which the web 2 is being wound up, reference numeral 92 denotes the core onto which the web 2 is to be wound up next, and reference numeral 93 denotes the core on which the web 2 has been wound up. The three arms rotate counterclockwise in FIG. 1 in order to replace the core for winding up the web 2. Each core installing unit is provided with a motor (not shown), and the core installed in each unit rotates when driven by the motor.

When the previous and new cores for winding up the web 2 are switched, the core connecting device (not shown) cuts the web 2 that is being wound onto the core 91, and connects the end of the cut web 2 to the new core 92. Thus, the web 2 can be wound up continuously.

The previous and new cores are switched as follows. First, the arms of the reel stand 94 are rotated so that the new core 92 approaches the line along which the web 2 is running. Next, the circumferential speed of the new core 92 is matched with the speed at which the web 2 is conveyed. Next, the core connecting device (not shown) is operated so that the web 2 is connected to the new core 92. Here, the new core 92 has an adhesive portion on the outer circumferential surface thereof, and the core connecting device presses the web 2 against this adhesive portion so that the web 2 is connected to the new core 92. After the connection, the core connecting device cuts the web 2 in front of the connected portion by means of a cutter so that the web 2 to be wound onto the previous core 91 is separated from the web 2 that has been connected to the new core 92. Thus, the previous and new cores for winding up the web 2 are switched.

Here, the previous and new cores are automatically switched. More specifically, the amount of web 2 that has been wound on the core is measured by a device (not shown) which measures the amount of wound web, and when a predetermined amount of web 2 has been wound on the core, the core is automatically replaced with a new core.

Although the inkjet printer 1 in the present embodiment has such a structure that the web 2 is wound onto the core in a roll, a structure for collecting the web 2 on which the image has been formed using a known folding machine may be used.

<Control System>

Figure 2:
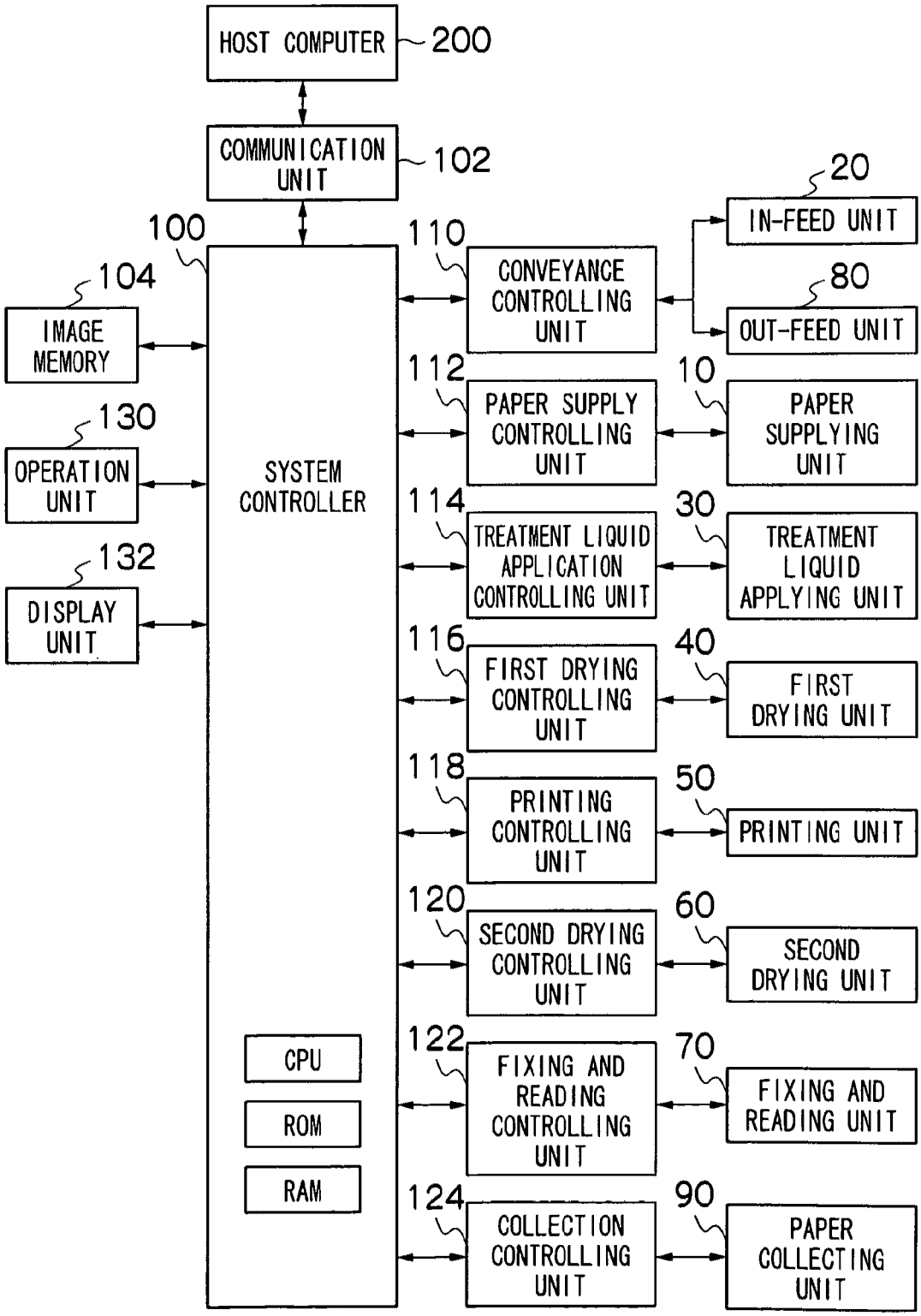
FIG. 2 is a block diagram showing the schematic structure of the control system in the inkjet printer.

FIG. 2 is a block diagram schematically showing the structure of the control system of the inkjet printer 1.

As shown in FIG. 2, the inkjet printer 1 includes the system controller 100, a communication unit 102, an image memory 104, a conveyance controlling unit 110, a web supply controlling unit 112, a treatment liquid application controlling unit 114, a first drying controlling unit 116, a printing controlling unit 118, a second drying controlling unit 120, a fixing and reading controlling unit 122, a web collection controlling unit 124, an operation unit 130 and a display unit 132.

The system controller 100 executes a predetermined control program to control the respective units in the inkjet printer 1. Moreover, the system controller 100 executes another predetermined control program to carry out various operation processes required for printing. The system controller 100 includes a CPU, a ROM and a RAM, and the ROM stores the control programs and various types of data required for printing.

The communication unit 102 includes a necessary communication interface, and transmits and receives data to and from a host computer 200 connected to the communication interface.

The image memory 104 functions as a temporary storage device for various types of data, including the image data, and the data is written and read through the system controller 100. The image data that has been taken in from the host computer 200 through the communication unit 102 is stored in the image memory 104.

The conveyance controlling unit 110 controls the operation of the in-feed unit 20 and the out-feed unit 80 in response to the instructions from the system controller 100, and thereby controls the conveyance of the web 2. More specifically, the conveyance controlling unit 110 controls the operation of the pair of in-feed rollers 21 arranged in the in-feed unit 20 and the operation of the pair of out-feed rollers 81 arranged in the out-feed unit 80 so that the web 2 runs from the web supplying unit 10 to the web collecting unit 90, and also controls the operation of the dancer roller 22 arranged in the in-feed unit 20 and the operation the dancer roller 82 arranged in the out-feed unit 80 so that the variation of the tension of the web 2 is controlled.

The web supply controlling unit 112 controls the operation of the web supplying unit 10 in response to the instructions from the system controller 100 to supply the web from the web roll. More specifically, the web supply controlling unit 112 controls the operation of the reel stand 14 arranged in the web supplying unit 10 so that the web roll is replaced, and also controls the operation of the web connecting device (not shown) arranged in the web supplying unit 10 so that the web is connected when the web roll is replaced.

The treatment liquid application controlling unit 114 controls the operation of the treatment liquid applying unit 30 in response to the instructions from the system controller 100 to apply the treatment liquid to the web 2. More specifically, the treatment liquid application controlling unit 114 controls the operation of the treatment liquid applying apparatus 31 arranged in the treatment liquid applying unit 30 so that the treatment liquid is applied to the web 2.

The first drying controlling unit 116 controls the operation of the first drying unit 40 in response to the instructions from the system controller 100 so that the treatment liquid applied to the web 2 is dried. More specifically, the first drying controlling unit 116 controls the operation of the dryer arranged in the first drying unit 40 so that the temperature and the amount of hot air to be blown against the web 2 are controlled, and thereby the treatment liquid applied to the web 2 is dried.

The printing controlling unit 118 controls the operation of the printing unit 50 in response to the instructions from the system controller 100 and forms an image on the web 2. More specifically, the printing controlling unit 118 controls the drive of the inkjet heads 51M, 51K, 51C and 51Y arranged in the printing unit 50 so that the ejections of ink droplets from the inkjet heads 51M, 51K, 51C and 51Y are controlled, and thereby a desired image is formed on the web 2.

The second drying controlling unit 120 controls the operation of the second drying unit 60 in response to the instructions from the system controller 100 so that the ink ejected onto the web 2 is dried. More specifically, the second drying controlling unit 120 controls the operation of the dryer arranged in the second drying unit 60 so that the temperature and the amount of hot air to be blown against the web 2 are controlled, and thereby the ink deposited on the web 2 is dried.

The fixing and reading controlling unit 122 controls the operation of the fixing and reading unit 70 in response to the instructions from the system controller 100 so that the formed image is fixed on the web 2 and read out. More specifically, the fixing and reading controlling unit 122 controls the operation of the ultraviolet ray irradiating source 71 arranged in the fixing and reading unit 70 so that the irradiation of the web 2 with ultraviolet rays is controlled, and the aggregated body of the treatment liquid and the ink on the web is solidified. The fixing and reading controlling unit 122 also controls the operation of the cooling device 72 arranged in the fixing and reading unit 70 so that the cooling of the web 2 is controlled and the image formed on the web 2 is fixed. Moreover, the fixing and reading controlling unit 122 also controls the operation of the scanner 74 arranged in the fixing and reading unit 70 so that the image formed on the web 2 is read out.

The web collection controlling unit 124 controls the operation of the web collecting unit 90 in response to the instructions from the system controller 100 to collect the web 2. More specifically, the web collection controlling unit 124 controls the operation of the reel stand 94 arranged in the web collecting unit 90 so that the core for winding up the web 2 is replaced, and also controls the operation of the core connecting device (not shown) arranged in the web collecting unit 90 so that the web 2 is connected to the new core when the previous core is replaced.

The operation unit 130 includes necessary operation devices (e.g., operation buttons, a keyboard and/or a touch panel) so that the operation information entered through the operation devices is inputted to the system controller 100. The system controller 100 carries out various types of processes in response to the operation information entered through the operation unit 130.

The display unit 132 includes a necessary display (e.g., an LCD panel), and outputs necessary information to the display in response to the instructions from the system controller 100.

The image data for printing on the web 2 is taken in by the inkjet printer 1 from the host computer 200 through the communication unit 102. The image data taken in by the inkjet printer 1 is stored in the image memory 104. The system controller 100 generates dot arrangement data by carrying out a necessary signal process on the image data stored in this image memory 104, and then controls the drive of the inkjet heads 51 (51M, 51K, 51C and 51Y) in accordance with the generated dot arrangement data so that the image represented by the image data is printed on the web 2.

The dot arrangement data is generated generally by carrying out a color conversion process and a half-toning process on the image data. The color conversion process is a process for converting the image data represented by sRGB or the like (e.g., 8 bit RGB image data) to color data (color data of MKCY in the present embodiment) for the ink colors used in the inkjet printer 1. The half-toning process is a process for generating dot arrangement data (dot arrangement data of MKCY in the present embodiment) for the ink colors through the error diffusion process carried out on the color data for the ink colors generated through the color conversion process.

The system controller 100 carries out the color conversion process and the half-toning process on the image data so as to generate dot arrangement data for the colors of MKCY. Then, the inkjet heads 51 (51M, 51K, 51C or 51Y) are driven in accordance with the generated dot arrangement data for the respective colors, and the image represented by the image data is printed on the web 2.

In the present embodiment, dot arrangement data representing dots of a large size, medium size and small size are generated in order to print an image represented by the image data. Accordingly, the inkjet heads 51 are formed so that dots of various sizes such as large, medium and small, can be formed. More specifically, the inkjet heads 51 are formed so as to be able to eject ink droplets for forming dots of the large size when landing on the web 2 (large droplets), ink droplets for forming dots of the medium size when landing on the web 2 (medium-sized droplets), and ink droplets for forming dots of the small size when landing on the web 2 (small droplets).

In the case of inkjet heads of the piezoelectric inkjet system, respective nozzles eject ink droplets when predetermined drive signals are applied to the piezoelectric elements (actuators) arranged so as to correspond to the respective nozzles. The drive signals are applied at a predetermined recording period, and the size of the ink droplets landing on the medium (dot diameter) can be changed by altering the waveform of the drive signals.

Figure 3:
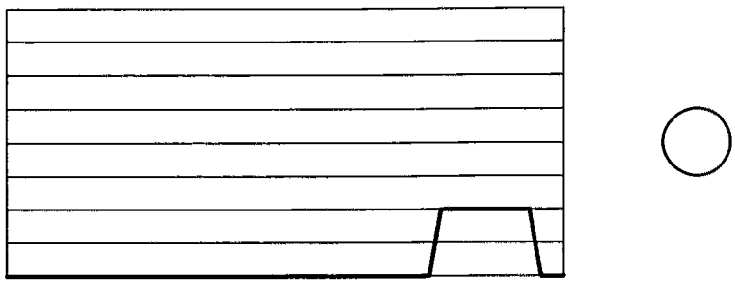
FIG. 3 is a diagram showing a set of waveforms of the drive signals applied to the actuator in the inkjet head.
Figure 3:
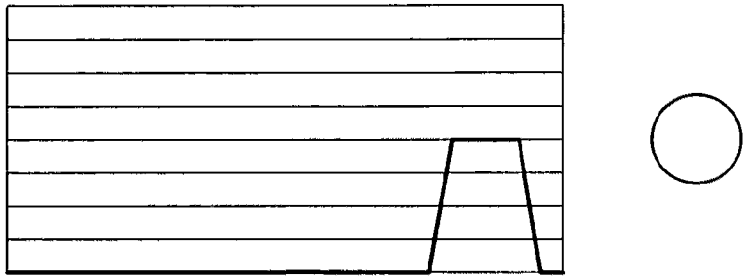
Figure 3:
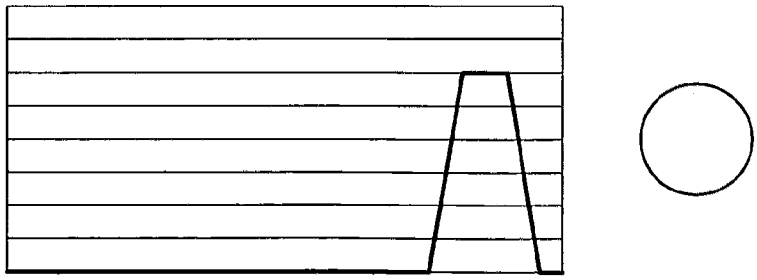

FIG. 3 is a diagram showing an embodiment of a set of waveforms of the drive signals in the case where the size of the ink droplets is changed by altering the peak value of the ejection pulse that is incorporated into one recording period.

In FIG. 3, a graph (a) shows the waveform of the drive signal in the case where an ink droplet of the small size is ejected, a graph (b) shows the waveform of the drive signal in the case where an ink droplet of the medium size is ejected, and a graph (c) shows the waveform of the drive signal in the case where an ink droplet of the large size is ejected. As shown in FIG. 3, the size of the ink droplets to be ejected can be changed by altering the peak value (voltage) of the ejection pulse. Thus, ink droplets having different sizes can be ejected so that gradation recording can be made possible.

Figure 4:
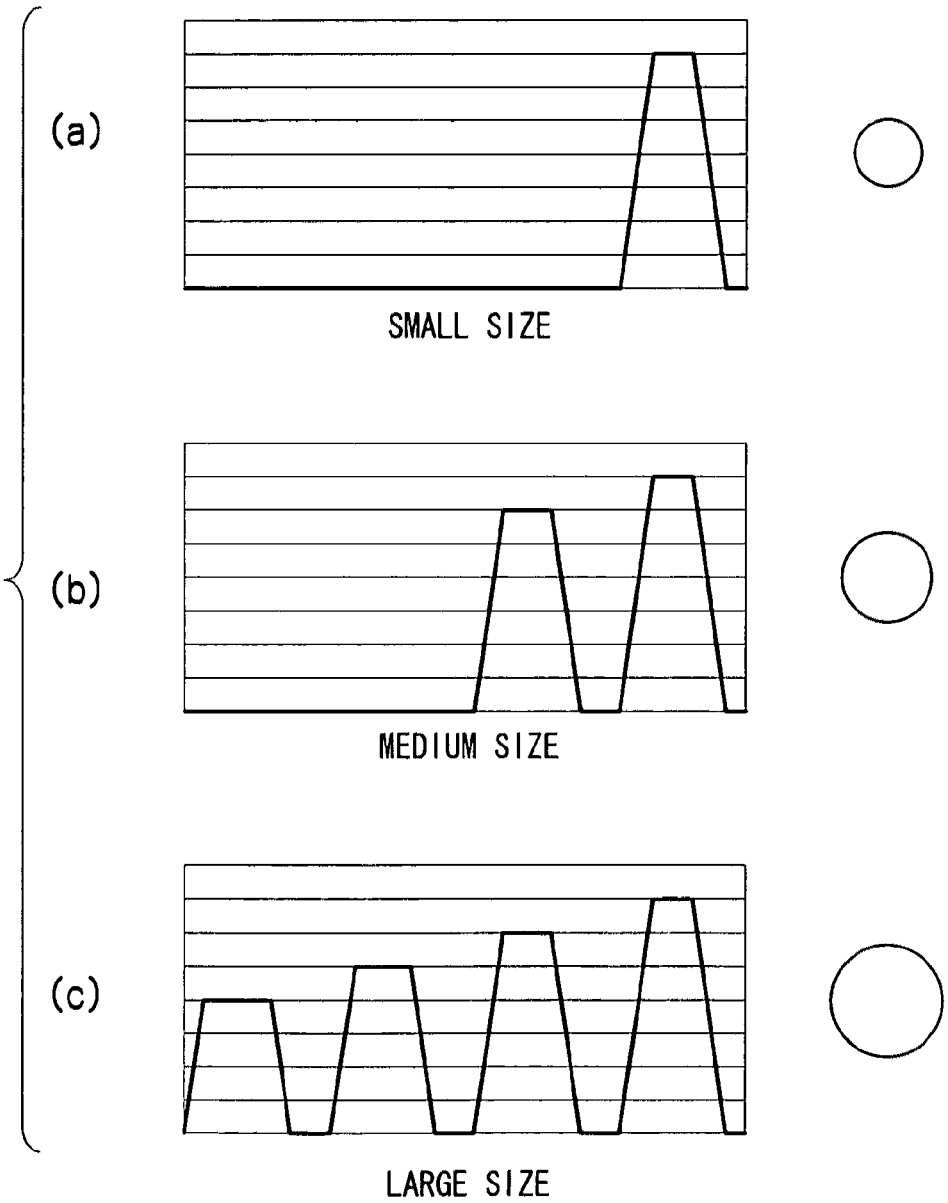
FIG. 4 is a diagram showing another set of waveforms of the drive signals applied to the actuator in the inkjet head.

FIG. 4 is a diagram showing another embodiment of a set of waveforms of the drive signals in the case where the size of the ink droplets is changed by altering the number of ejection pulses incorporated into one recording period.

In FIG. 4, a graph (a) shows the waveform of the drive signal in the case where an ink droplet of the small size is ejected, a graph (b) shows the waveform of the drive signal in the case where an ink droplet of the medium size is ejected, and a graph (c) shows the waveform of the drive signal in the case where an ink droplet of the large size is ejected.

As shown in FIG. 4, the ejection pulses are incorporated at constant intervals. When only one ejection pulse is incorporated, an ink droplet of the small size is ejected; when two ejection pulses are incorporated, an ink droplet of the medium size is ejected; and when four ejection pulses are incorporated, an ink droplet of the large size is ejected.

Here, when the ejection pulses are incorporated in such a manner that the peak values gradually increase as shown in FIG. 4, an ink droplet ejected afterward catches up with the ink droplet ejected beforehand, and thus the droplets can land on the recording medium in a state of one droplet (so-called merger in the air).

Although the peak values of the ejection pulses are altered in the waveforms shown in FIG. 4, the size of the ejected ink droplet can be changed by altering the number of ejection pulses that are incorporated while keeping the peak values of the ejection pulses constant. In this case, ink droplets land on the same place one after another so that a dot of a predetermined size can be formed.

Here, the recording period is altered in accordance with the running speed of the web 2. More specifically, the recording period is constant while the web 2 is running at a constant speed, and the recording period is altered in accordance with the variation in the speed of the web 2 while the web 2 is accelerating and also while the web 2 is decelerating. Thus, printing is made possible while the web 2 is accelerating and also while the web 2 is decelerating.

The inkjet printer 1 in the present embodiment is controlled in such a manner that when the speed of the web 2 (the web conveyance speed at the image formation) is varied, the dot arrangement data is adjusted so that an image with a constant quality is always printed. This point is described in detail later.

Outline of Printing Operation in Inkjet Printer

The web 2 is fed by the in-feed unit 20 and the out-feed unit 80 so as to run from the web supplying unit 10 to the web collecting unit 90.

The web 2 that has been drawn out from the web roll in the web supplying unit 10 first passes through the treatment liquid applying unit 30. Then, the treatment liquid is applied to the printing surface when the web 2 passes.

The web 2 that has passed through the treatment liquid applying unit 30 next passes through the first drying unit 40. When the web 2 passes, hot air is blown against the printing surface so that the treatment liquid applied on the printing surface is dried.

The web 2 that has passed through the first drying unit 40 next passes through the printing unit 50. When the web 2 passes, the ink droplets are ejected from the inkjet heads 51M, 51K, 51C and 51Y and deposited onto the printing surface so that an image is formed.

The web 2 that has passed through the printing unit 50 next passes through the second drying unit 60. When the web 2 passes, hot air is blown against the printing surface so that the ink deposited on the printing surface is dried.

The web 2 that has passed through the second drying unit 60 next passes through the fixing and reading unit 70. When the web 2 passes, the printing surface is irradiated with ultraviolet rays so that the aggregated body of the ink and the treatment liquid is solidified, the web 2 is then cooled so that the formed image is fixed on the web 2, and the formed image is read out by the scanner 74.

After that, the web 2 that has passed through the fixing and reading unit 70 is fed to the web collecting unit 90 and is wound on the core into a roll in the web collecting unit 90.

As described above, the inkjet printer 1 in the present embodiment prints the image by means of the inkjet system onto the web 2 that is continuously fed out from the web supplying unit 10.

Here, the web roll for supplying the web 2 is automatically replaced with a new web roll just before the web 2 runs out. Thereby, the web 2 can be supplied continuously. The same can be said for the core for winding up the web 2 on which the image has been printed, and when a predetermined amount of web 2 is wound up on the core, the core is automatically replaced with a new core. Thereby, the web 2 can be collected continuously.

Printing Operation for Printing Even while Web is Accelerating or Decelerating

In the case of a printer for printing an image on the web 2 by means of the inkjet system as the inkjet printer 1 in the present embodiment, if the printing stands by until the web 2 reaches a constant speed, a large amount of web 2 would be fed and a large amount of web would end up being wasted. Hence, it is preferable for the printer for printing an image on the web 2 by means of the inkjet system to be able to print an image even while the web 2 is accelerating or decelerating as the inkjet printer 1 in the present embodiment. It is necessary to eject ink droplets in synchronization with the running of the web 2 in order to print an image even while the web 2 is accelerating or decelerating.

However, a high quality image cannot be formed by simply synchronizing the ejection of the ink droplets with the running of the web 2. More specifically, in the inkjet system, if the temporal interval between ejections of ink droplets varies, then the state of interference between the ink droplets deposited on the web 2 varies, and thus such a problem arises that the density of the images varies. Furthermore, ink droplets to form a plurality of dots per se may merge into a single large droplet, and thereby such a problem arises that the formation of the plurality of dots is lost.

Thus, in the inkjet printer 1 in the present embodiment, the following measures are taken so that the density of the formed images is prevented from varying even when the images are printed while the web 2 is accelerating or decelerating.

<First Method>

In the first method, the data for arranging dots to form the image is adjusted in accordance with the speed of the web 2. More specifically, the arrangement of the dots to form the image is adjusted so that the image having a constant density can be formed even when the web conveyance speed at the image formation on the web 2 varies.

The data for arranging dots is adjusted with information that is acquired in advance. For example, in order to acquire the adjustment information for adjusting the data for arranging dots, a plurality of images are formed using the same data for arranging dots while changing the speed (the web conveyance speed at the image formation) so as to obtain conditions for making the density of the images constant for the respective speeds, and these conditions are utilized as the adjustment information. The conditions for making the image density constant relate to the appearance rate of dot sizes, and the appearance rate of dot sizes corresponding to the image density is altered in accordance with the web conveyance speed at the image formation. In the inkjet printer 1 in the present embodiment, images are formed with dots of three sizes of large, medium and small, and the appearance rate of the dots of the three sizes corresponding to the image density is altered in accordance with the web conveyance speed at the image formation.

Information on the appearance rate of dots corresponding to the image density is defined in the form of a set of gradation curves, and the data for arranging dots is adjusted in accordance with the gradation curves.

Figure 5:
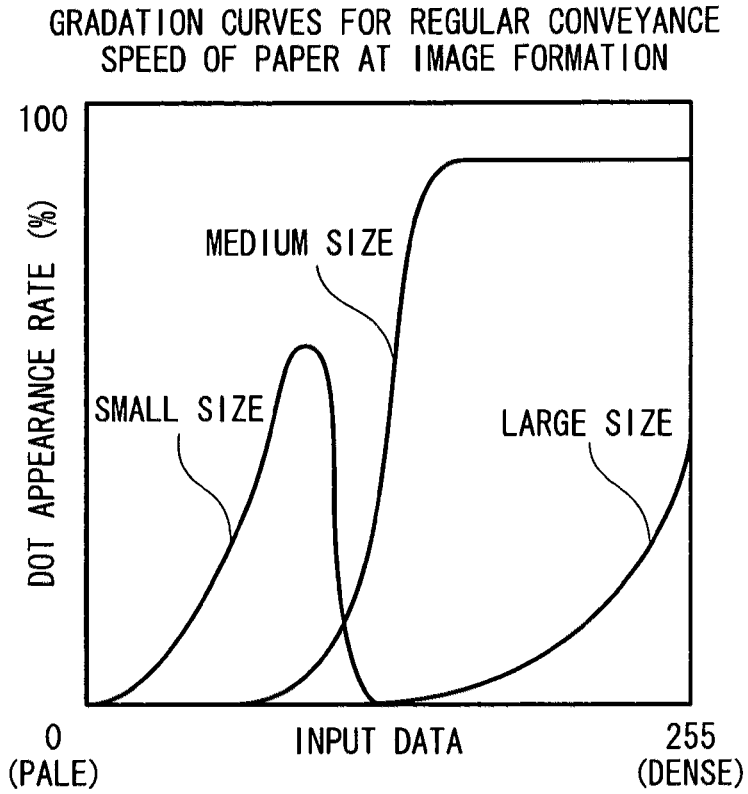
FIG. 5 is a diagram showing a set of gradation curves.
Figure 5:
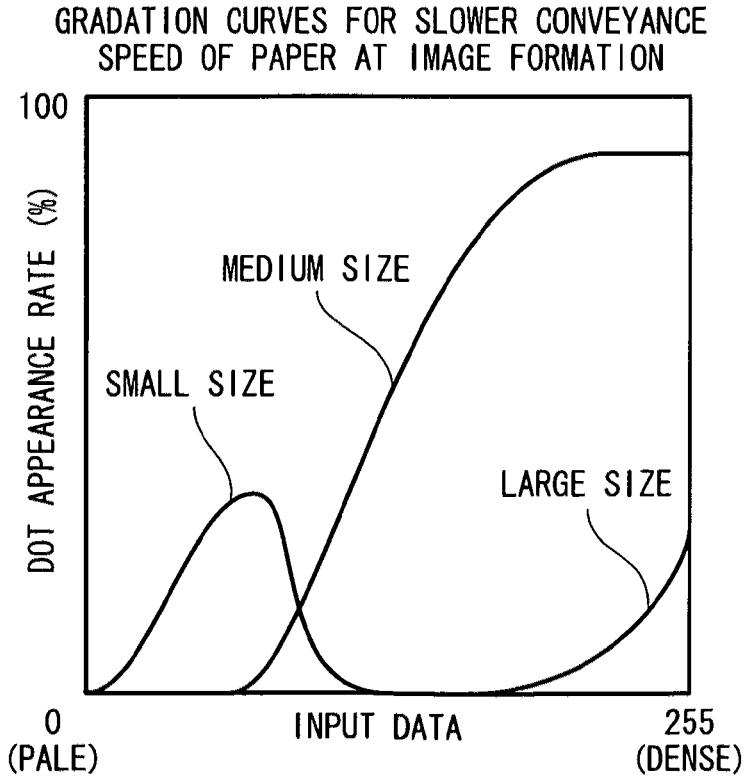

FIG. 5 is a diagram showing the gradation curves in the present embodiment. In FIG. 5, a graph (a) shows the gradation curves when the web conveyance speed at the image formation is regular, and a graph (b) shows the gradation curves when the web conveyance speed at the image formation is lower than the regular speed.

The information on the set of gradation curves is prepared for each speed so that the data for arranging dots can be adjusted in accordance with the web conveyance speed at the image formation that is measured in the printing unit 50.

Here, the data for arranging dots generated from the image data (RGB) is the data for arranging dots when the web conveyance speed at the image formation is regular, and in the case where the speed of the web 2 varies, a necessary adjustment process is carried out on the data for arranging dots when the web conveyance speed at the image formation is regular. This process is carried out by the system controller 100 in accordance with a predetermined control program. More specifically, the system controller 100 acquires information on the web conveyance speed at the image formation from the mechanism for measuring the web conveyance speed at the image formation in the printing unit 50, then retrieves the information on the gradation curves corresponding to the measured speed stored in the ROM, and adjusts the data for arranging dots when the web conveyance speed at the image formation is regular, by means of the retrieved information. Then, an image is printed in the printing unit 50 by using the adjusted data for arranging dots. Thus, the image can be printed on the web 2 even when the web 2 is accelerating or decelerating, and the high quality image can be stably printed without a variation in the image density.

<<Gradation Curves>>

The information on the gradation curves can be defined in detail within the range where the web conveyance speed at the image formation varies so that high quality images with more stable density can be printed. In the case where the regular speed of the web conveyance at the image formation is 300 m/min and the web conveyance speed at the image formation varies in the range from 0 to 350 m/min, for example, the information on a set of gradation curves is prepared for each speed with increments of 1 m/min.

Meanwhile, the capacity of the memory (the ROM in the present embodiment) required for the storage of the information needs to be greater when the number of pieces of information on the sets of gradation curves is high.

Therefore, the prepared pieces of information on the gradation curves may be thinned out to a certain extent, and in the case where there is no information on the set of gradation curves corresponding to the measured speed, the information on the gradation curves for the speed near the measured speed may be used to adjust the data for arranging dots. For example, information on the sets of gradation curves may be prepared with increments of 10 m/min, and in the case where the measured speed is in between the speeds for which the information is prepared, the information on the set of gradation curves corresponding to the closest speed is used (in the case where the web conveyance speed at the image formation is measured as 52 m/min, for example, the information on the set of gradation curves for the speed of 50 m/min is used). Alternatively, the information on the set of gradation curves corresponding to the closest speed faster than or slower than the measured speed may be used (in the case where the web conveyance speed at the image formation is measured as 52 m/min, for example, the information on the set of gradation curves for the speed of 50 m/min or 60 m/min is used).

Moreover, the information on gradation curves corresponding to the measured web conveyance speed at the image formation can be estimated in reference to the information on the set of gradation curves for the closest speeds which are respectively lower and higher than the measured web conveyance speed at the image formation so that the dot arrangement data can be adjusted using the estimated information on the gradation curves. In the case where the information on the sets of gradation curves is prepared for the speeds with increments of 10 m/min, for example, when the measured web conveyance speed at the image formation is 52 m/min, the information on the set of gradation curves for the speed of 50 m/min and the set of gradation curves for the speed of 60 m/min is used to estimate the information on the set of gradation curves for the speed of 52 m/min.

Thus, the capacity of the memory required to store the information on the sets of gradation curves can be kept low while high quality images can be printed.

It is preferable for gradation curves to be prepared in such a manner that the appearance rate of dots of the small size increases as the web conveyance speed at the image formation increases, and the appearance rate of dots of the large size increases as the web conveyance speed at the image formation decreases. More specifically, the higher the web conveyance speed at the image formation is, the easier it is for the landed droplets to interfere with each other, and therefore the rate of dots of the small size is increased as the web conveyance speed at the image formation increases, so that the possibility of interference between the landed droplets can be reduced. On the other hand, it is difficult for the landed droplets to interfere with each other when the web conveyance speed at the image formation is low, and therefore the appearance rate of dots of the large size is increased so that the load applied to the inkjet heads can be reduced. Thus, higher quality images can be printed.

Moreover, the image density variation depends on the printing conditions, including the types of ink and paper (web) used, and it is then preferable to prepare sets of gradation curves respectively for different printing conditions.

<<Adjustment of Data for Arranging Dots>>

The data for arranging dots can be adjusted simultaneously for all the regions, and can also be adjusted only for necessary regions. Thereby, the data for arranging dots can be adjusted efficiently.

For example, the data for arranging dots can be adjusted only for regions having a predetermined image density or higher. More specifically, the positional interval between dots is great in regions having a low image density where a possibility of interference between landed droplets is low, and therefore an image is formed in accordance with the original arrangement of dots without adjustment. On the other hand, the positional interval between dots is small in regions having a high image density where a possibility of interference between landed droplets is high when the web conveyance speed at the image formation varies, and therefore the arrangement of dots is adjusted.

Thus, the data for arranging dots is adjusted only in the necessary regions, and thereby the speed of the adjustment process can be increased and the data for arranging dots can be adjusted efficiently.

As described above, the variation in the image density when the web conveyance speed at the image formation varies greatly depends on the positional interval between dots formed of the droplets deposited on the web 2, and it is then possible to adjust only the data for arranging dots in the regions where ink droplets are deposited to form dots which are adjacent to each other. For example, the data for arranging dots for regions where droplets are deposited for surrounding four or eight adjacent dots (i.e., "above, below, right, left", "upper right, upper left, lower right, lower left" or "upper right, above, upper left, left, lower left, below, lower right, right") are adjusted. Thereby, only the data for the necessary regions can be adjusted, and therefore the speed of the adjustment process can be increased.

The data for arranging dots can be adjusted every time the web conveyance speed at the image formation varies, but can also be adjusted for each image. In this case, the data for arranging dots may be adjusted in accordance with the average speed when the web passes through the printing unit, or the data for arranging dots may be adjusted in accordance with the speed when the web enters into the printing unit. Thus, it is not necessary to adjust the data for arranging dots every time, and an image can be formed efficiently.

The data for arranging dots may be adjusted in accordance with the average web conveyance speed at the image formation only in the case where the variation in the web conveyance speed at the image formation for one image is not greater than a predetermined value (first threshold value). More specifically, when the web conveyance speed at the image formation slowly varies as when the web 2 is gradually accelerating or decelerating, the variation in the image density is also small, and therefore the data for arranging dots is adjusted in accordance with the average web conveyance speed at the image formation. Thus, excessive adjustment can be prevented and an image can be formed efficiently.

In the case where the web 2 runs more slowly, the data for arranging dots may be adjusted in accordance with an average speed of the web conveyance speeds at the image formation for a plurality of images. More specifically, in the case where the variation in the web conveyance speed at the image formation for one image is not greater than a second threshold value, which is smaller than the first threshold value (i.e., in the case where the variation in the web conveyance speed at the image formation while a plurality of images are formed is not greater than a predetermined threshold value), the data for arranging dots for each image is adjusted in accordance with the average speed of the web conveyance speeds at the image formation for the plurality of images. Thus, the images can be formed more efficiently.

Here, the first and second threshold values may vary depending on the printing conditions (e.g., the types of ink and paper (web) used), and it is then preferable to set the first and second threshold values in accordance with the printing conditions.

<Second Method>

In the second method, the data for arranging dots to form the image is not adjusted but the amount of ink ejected from the nozzles is adjusted in accordance with the web conveyance speed at the image formation on the web 2. More specifically, the amount of ink droplets ejected from the nozzles is adjusted in accordance with the web conveyance speed at the image formation so that the image density does not vary even when the web conveyance speed at the image formation on the web 2 varies.

The ejection amount is adjusted with information that is acquired in advance. For example, in order to acquire the adjustment information for adjusting the ejection amount, a plurality of images are formed using the same data for arranging dots while changing the speed (the web conveyance speed at the image formation) so as to obtain conditions for the ejection amount in order to make the density of the images constant for the respective speeds, and these conditions are utilized as the adjustment information.

The inkjet printer 1 in the present embodiment forms images with dots of three sizes such as large, medium and small, and therefore adjustment conditions for the ejection amount are acquired for dots of each size.

The ejection amount is adjusted by altering the waveform of the drive signal applied to the piezoelectric element. The ejection amount is adjusted by altering either the peak value of the ejection pulse or the pulse width of the ejection pulse, or both, for example.

Figure 6:
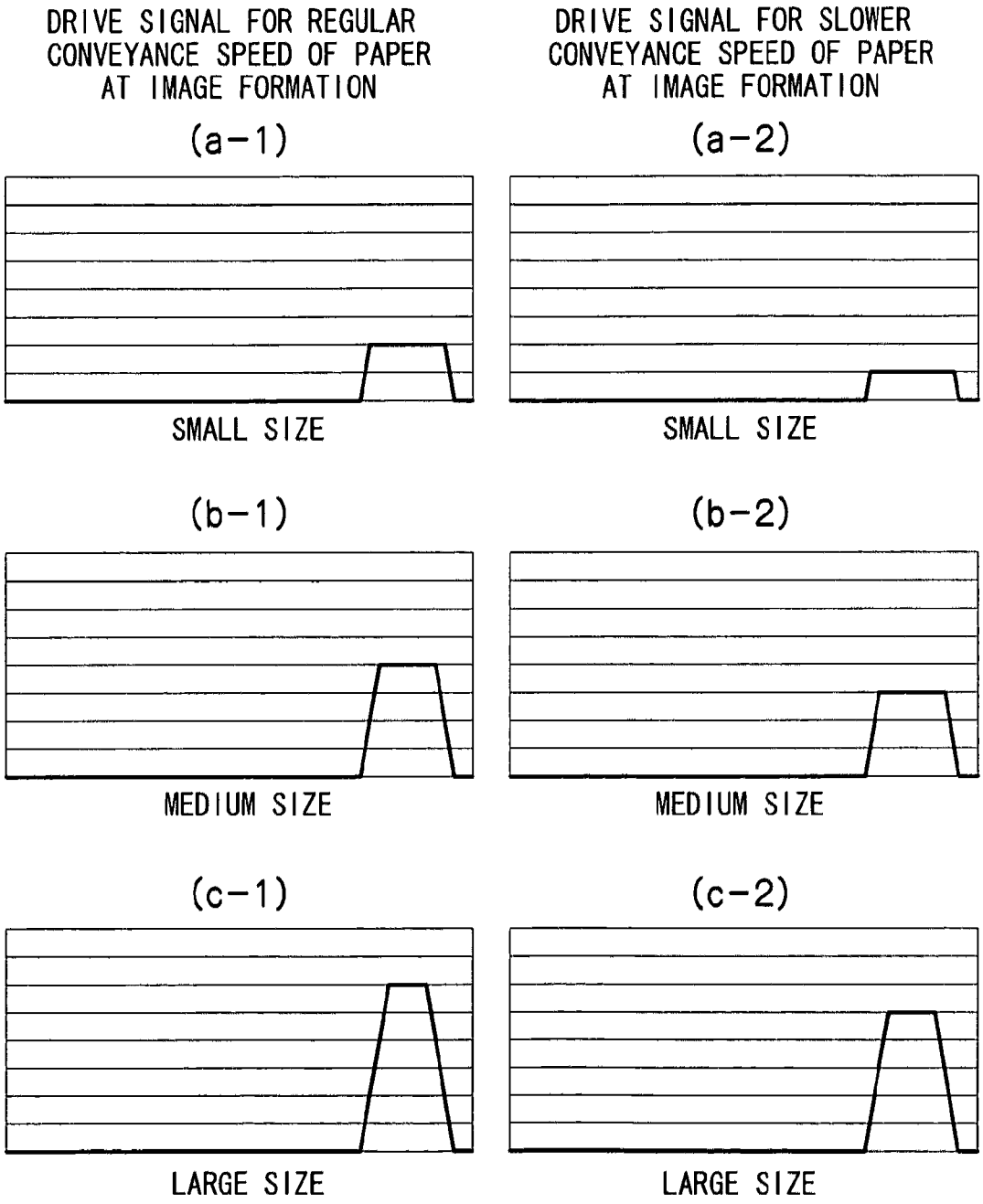
FIG. 6 is a diagram showing still other sets of waveforms of the drive signals applied to the actuator in the inkjet head.

FIG. 6 is a diagram showing an embodiment of a set of waveforms of the drive signals in the case where the ejection amount is changed by altering the peak value of the ejection pulse. In FIG. 6, graphs (a-1), (b-1) and (c-1) show the waveforms of the drive signals when the web conveyance speed at the image formation is regular, and graphs (a-2), (b-2) and (c-2) show the waveforms of the drive signals when the web conveyance speed at the image formation is lower than the regular speed.

When the web conveyance speed at the image formation is low, since the interference between landed droplets is less effective, then the peak values (the applied voltages) are lowered so that the ejection amount can be reduced for dots of each size as shown in FIG. 6.

Figure 7:
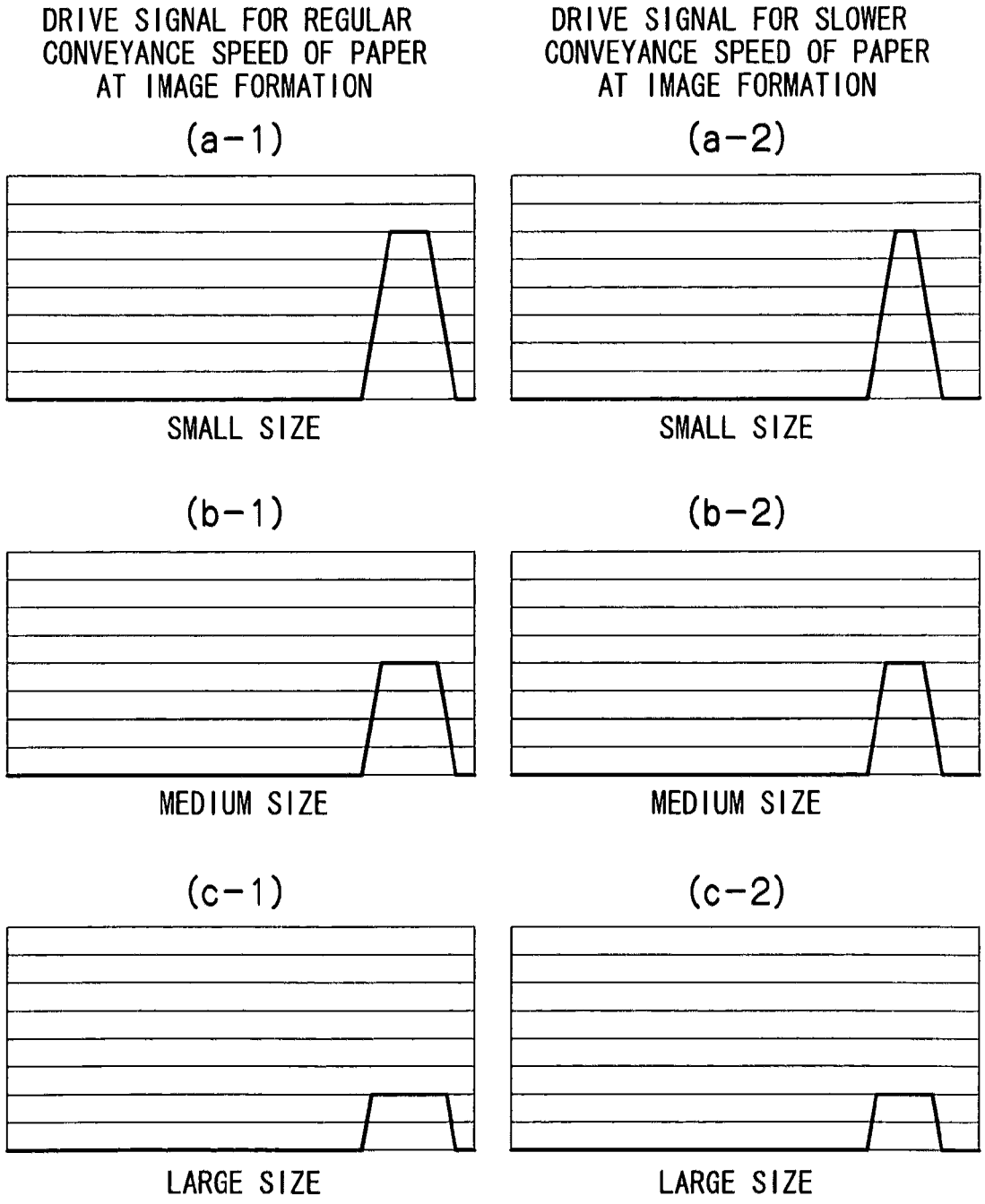
FIG. 7 is a diagram showing yet other sets of waveforms of the drive signals applied to the actuator in the inkjet head.

FIG. 7 is a diagram showing an embodiment of a set of waveforms of the drive signals in the case where the ejection amount is changed by altering the width of ejection pulse. In FIG. 7, graphs (a-1), (b-1) and (c-1) show the waveforms of the drive signals when the web conveyance speed at the image formation is regular, and graphs (a-2), (b-2) and (c-2) show the waveforms of the drive signals when the web conveyance speed at the image formation is lower than the regular speed.

When the web conveyance speed at the image formation is low, since the interference between landed droplets is less effective, then the pulse width is narrowed so that the ejection amount can be reduced for dots of each size as shown in FIG. 7.

Although the ejection amount is adjusted by altering the peak value or the width of the pulse in the embodiments shown FIGS. 6 and 7, the ejection amount may be adjusted by altering both the peak value and the width of the pulse.

Likewise, in the case where the size of the ink droplets is changed by altering the number of ejection pulses incorporated into one recording period (see FIG. 4), the ejection amount can be adjusted by altering either the peak value of the ejection pulse or the pulse width of the ejection pulse, or both.

Thus, the ejection amount is adjusted by altering the waveform of the drive signal applied to the piezoelectric element.

As described above, images are formed using the same data for arranging dots in different speeds at which the web is conveyed at the image formation, and adjustment information is acquired from the thus formed images. More specifically, how the image density (gradation) varies for different speeds at which the web is conveyed at the image formation is measured, and conditions for preventing the variation are acquired as the adjustment information.

The acquired adjustment information is stored in the ROM, for example. The system controller 100 reads out the adjustment information stored in the ROM so as to find the ejection amount in conformity with the web conveyance speed at the image formation, and controls the printing controlling unit 118 so as to accordingly drive the inkjet heads 51.

Thus, an image can be printed on the web 2 even when the web 2 is accelerating or decelerating, and at the same time a stable, high quality image can be printed without a variation in the image density.

<<Adjustment Information on Ejection Amount>>

The adjustment information for adjusting the ejection amount can be defined in detail within the range where the web conveyance speed at the image formation varies so that high quality images with more stable density can be printed. In the case where the regular speed of the web conveyance at the image formation is 300 m/min and the web conveyance speed at the image formation varies in the range from 0 to 350 m/min, for example, the adjustment information on the ejection amount is prepared for each speed with increments of 1 m/min.

Meanwhile, the capacity of the memory (the ROM in the present embodiment) required for the storage of the information needs to be greater when the number of pieces of adjustment information on the ejection amount is high.

Therefore, the prepared pieces of adjustment information on the ejection amount may be thinned out to a certain extent, and in the case where there is no adjustment information on the ejection amount corresponding to the measured speed, the adjustment information on the ejection amount for the speed near the measured speed may be used to adjust the ejection amount. For example, the adjustment information on the ejection amount may be prepared with increments of 10 m/min, and in the case where the measured speed is in between the speeds for which the adjustment information is prepared, the adjustment information on the ejection amount corresponding to the closest speed is used (in the case where the web conveyance speed at the image formation is measured as 52 m/min, for example, the adjustment information on the ejection amount for the speed of 50 m/min is used). Alternatively, the adjustment information on the ejection amount corresponding to the closest speed faster than or slower than the measured speed may be used (in the case where the web conveyance speed at the image formation is measured as 52 m/min, for example, the adjustment information on the ejection amount for the speed of 50 m/min or 60 m/min is used).

Moreover, the adjustment information on the ejection amount corresponding to the measured web conveyance speed at the image formation can be estimated in reference to the adjustment information on the ejection amount for the closest speeds which are respectively lower and higher than the measured web conveyance speed at the image formation so that the ejection amount can be adjusted using the estimated adjustment information on the ejection amount. In the case where the adjustment information on the ejection amount is prepared for the speeds with increments of 10 m/min, for example, when the measured web conveyance speed at the image formation is 52 m/min, the adjustment information on the ejection amount for the speed of 50 m/min and for the speed of 60 m/min is used to estimate the adjustment information on the ejection amount for the speed of 52 m/min.

Thus, the capacity of the memory required to store the adjustment information on the ejection amount can be kept low while high quality images can be printed.

Moreover, the image density variation depends on the printing conditions, including the types of ink and paper (web) used, and it is then preferable to prepare the adjustment information on the ejection amount for each of different printing conditions.

<<Adjustment of Ejection Amount>

The ejection amount (drive waveform) can be adjusted simultaneously for all the regions, and can also be adjusted only for necessary regions. Thereby, the ejection amount can be adjusted efficiently.

For example, the ejection amount can be adjusted only for regions having a predetermined image density or higher. More specifically, the positional interval between dots is great in regions having a low image density where a possibility of interference between landed droplets is low, and therefore an image is formed in accordance with the original ejection amount without adjustment. On the other hand, the positional interval between dots is small in regions having a high image density where a possibility of interference between landed droplets is high when the web conveyance speed at the image formation varies, and therefore the ejection amount is adjusted.

Thus, the ejection amount is adjusted only in the necessary regions, and thereby the speed of the adjustment process can be increased and the ejection amount (drive waveform) can be adjusted efficiently.

As described above, the variation in the image density when the web conveyance speed at the image formation varies greatly depends on the positional interval between dots formed of the droplets deposited on the web 2, and it is then possible to adjust only the ejection amount (drive waveform) in the regions where ink droplets are deposited to form dots which are adjacent to each other. For example, the ejection amount for regions where droplets are deposited for surrounding four or eight adjacent dots (i.e., "above, below, right, left", "upper right, upper left, lower right, lower left" or "upper right, above, upper left, left, lower left, below, lower right, right") are adjusted. Thereby, only the ejection amount for the necessary regions can be adjusted, and therefore the speed of the adjustment process can be increased.

The ejection amount can be adjusted every time as the web conveyance speed at the image formation varies, and can also be adjusted for each image. In this case, the ejection amount may be adjusted in accordance with the average speed when the web passes through the printing unit, or the ejection amount may be adjusted in accordance with the speed when the web enters into the printing unit. Thus, it is not necessary to adjust the ejection amount every time, and an image can be formed efficiently.

The ejection amount may be adjusted in accordance with the average web conveyance speed at the image formation only in the case where the variation in the web conveyance speed at the image formation for one image is not greater than a predetermined value (first threshold value). More specifically, when the web conveyance speed at the image formation slowly varies as when the web 2 is gradually accelerating or decelerating, the variation in the image density is also small, and therefore the ejection amount is adjusted in accordance with the average web conveyance speed at the image formation. Thus, excessive adjustment can be prevented and an image can be formed efficiently.

In the case where the web 2 runs more slowly, the ejection amount may be adjusted in accordance with an average speed of the web conveyance speeds at the image formation for a plurality of images. More specifically, in the case where the variation in the web conveyance speed at the image formation for one image is not greater than a second threshold value, which is smaller than the first threshold value (i.e., in the case where the variation in the web conveyance speed at the image formation while a plurality of images are formed is not greater than a predetermined threshold value), the ejection amount for each image is adjusted in accordance with the average speed of the web conveyance speeds at the image formation for the plurality of images. Thus, the images can be formed more efficiently.

Here, the first and second threshold values may vary depending on the printing conditions (e.g., the types of ink and paper (web) used), and it is then preferable to set the first and second threshold values in accordance with the printing conditions.

For example, the first threshold value is set to be equal to the smallest variation in the web conveyance speed at the image formation where the maximum value of shift of the image density and color within one formed image satisfies $\Delta E=(\Delta a^{*2}+\Delta b^{*2}+\Delta L^{*2})^{1/2}\leq 2$ in the color space of L*, a* and b* (defined in JIS Z 8729). Similarly, the second threshold value is set to be equal to the smallest variation in the web conveyance speed where the shift of density and color within a plurality of formed images satisfies $\Delta E\leq 2$.

Thus, the adjustment of the ejection amount for each image is simplified in such a range that the variation in the image quality cannot be perceived, and thus images can be formed efficiently.

Method for Acquiring Data on Formed Image

As described above, in the inkjet printer 1 in the present embodiment, an image data of the image formed by the printing unit 50 (formed image) can be acquired by the scanner 74 incorporated in the fixing and reading unit 70.

The scanner 74 is provided with the line CCD sensor arranged so as to be perpendicular to the conveyance direction of the web 2, the optical system for forming an optical image on the line CCD sensor, and a light source, and reads out the images formed on the running web 2. The light source includes a white fluorescent lamp, for example, so that the running web 2 is irradiated with white light.

Adjustment information on the data for arranging dots and on the ejection amount is determined by analyzing the image data acquired by reading out the formed image by the scanner 74. Moreover, defective ejection, positional shift and the image density variation in the printing unit 50 are also detected by analyzing the image data acquired by the scanner 74.

The scanner 74 arranged in the fixing and reading unit 70 is optimized to acquire the image data from the images formed on the web 2 that is conveyed at a constant conveyance speed, and the conditions (amount of light from the light source, time for acquiring one pixel (so-called shutter speed (exposure duration)), the size of the optical aperture of the CCD, and the like) for acquiring the image data from the formed images are accordingly set.

Figure 8:
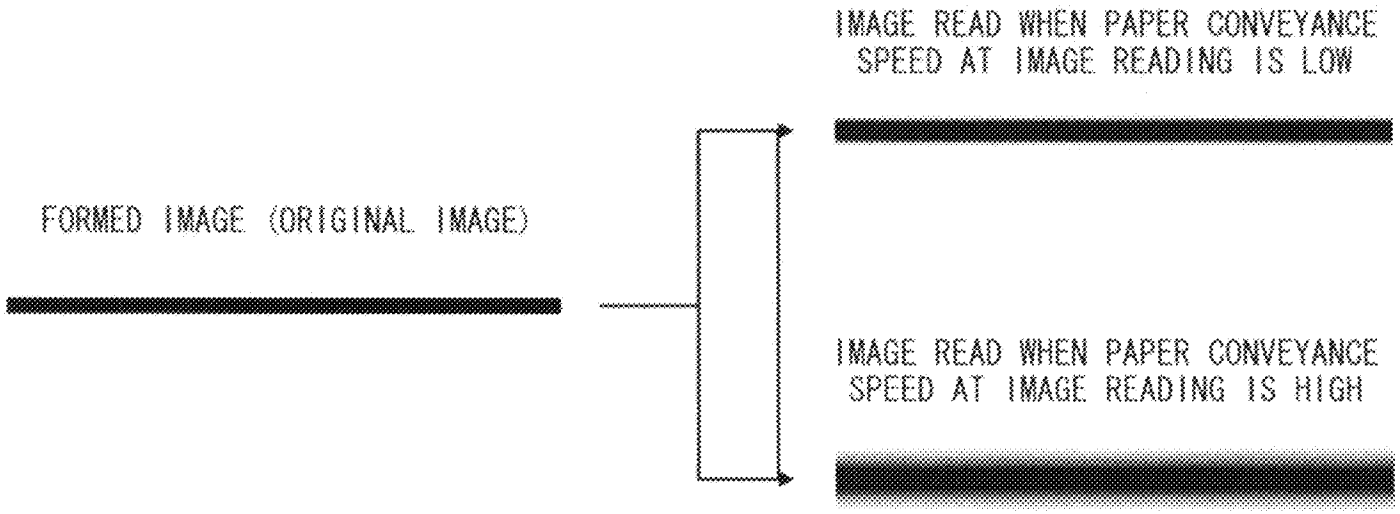
FIG. 8 is a diagram for illustrating a difference in unfocused state of read images due to a difference in the paper conveyance speed while the images are read.

Then, when the conveyance speed of the web 2 at the image data acquisition (the web conveyance speed at the image data acquisition) varies, the conditions for acquiring the image data from the formed images vary, and the unfocusing state of the read image also varies. More specifically, as shown in FIG. 8, the unfocusing state of the read image becomes greater as the web conveyance speed at the image data acquisition increases.

Hence, in the inkjet printer 1 in the present embodiment, the image data acquired by the scanner 74 is corrected in accordance with the web conveyance speed at the image data acquisition, and the variation in the acquired image data due to the variation in the web conveyance speed at the image data acquisition is corrected. More specifically, a correction function that is set in accordance with the web conveyance speed at the image data acquisition is used to carry out a predetermined operation process on the acquired image data, and thus the acquired image data is corrected.

The correction function is formed of a 1×n filter matrix for correcting the acquired image data in the conveyance direction of the web 2, for example, and n is determined in accordance with the web conveyance speed at the image data acquisition. More specifically, n (here, n is an odd number of 3 or more) is selected so as to be the number of acquired pixels for the length corresponding to the amount of the web 2 that moves during the duration for acquiring one pixel (exposure duration).

The filter parameter is determined in such a manner that the value thereof implements spatial frequency properties that are opposite to those when the image is unfocused, and the total energy of the acquired image data is not greatly different before and after the operation process.

Information on the filter matrix that has been set is stored in the ROM. The system controller 100 reads out the information on the filter matrix corresponding to the web conveyance speed at the image data acquisition from the ROM and carries out a predetermined filtering process on the acquired image data so as to correct the acquired image data. More specifically, the value of n is automatically set in accordance with the web conveyance speed at the image data acquisition, and therefore the information on the corresponding filter matrix is read out from the ROM, and the read out filter matrix is used to carry out the filtering process on the acquired image data.

Figure 9:
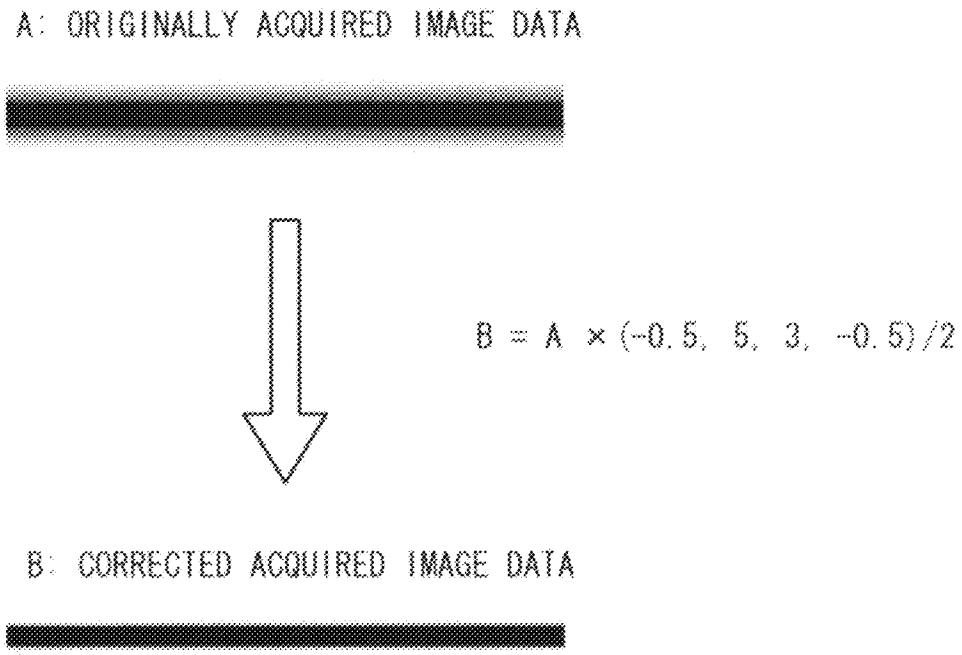
FIG. 9 is a conceptual diagram showing the correction process carried out on the acquired image data.

FIG. 9 is a conceptual diagram showing a correction process carried out on the acquired image data. The filtering process is carried out on the originally acquired image data (A) with the filter matrix (X) corresponding to the web conveyance speed at the image data acquisition so that the corrected image data (B) is obtained. FIG. 9 shows an example where n=3. In this case, the filter matrix (X) is formed of one column×three rows. The filter matrix (X) is used to correct the acquired image data in the conveyance direction of the web 2.

Thus, the variation in the acquired image data due to the variation of the web conveyance speed at the image data acquisition can be corrected. Then, the thus-corrected acquired image data is analyzed and defective ejection from the printing unit 50 is detected so that defective ejection can be detected precisely.

Moreover, the system controller 100 analyzes also the corrected acquired image data so as to obtain the information on the image density, the color, the unevenness, the dot diameters, the line widths, the existence of formed dots, the existence of satellite droplets, an abnormal image formation, and the like. Thus, more precise detection is possible.

Information on the images formed by changing the web conveyance speed at the image formation is necessary in order to acquire the adjustment information on the data for arranging dots and the adjustment information on the ejection amount, and these pieces of adjustment information can also be obtained by means of the corrected acquired image data.

Here, the unfocusing state depends also on the properties of the optical system, and then the filter parameter is determined by taking the properties of the optical system into consideration so that the acquired image data can be corrected more appropriately and a better acquired image data can be obtained.

Method for Reading Image Formed

In the above-described method, the image data acquired by the scanner 74 is corrected so that the variation in the acquired image data due to the variation in the web conveyance speed at the image data acquisition is corrected; however, the variation in the acquired image data due to the variation in the web conveyance speed at the image data acquisition can be prevented by changing the method for acquiring the image data with the scanner 74.

In the following, the method for acquiring the image data with the scanner 74 in order to prevent the variation in the acquired image data due to the variation in the web conveyance speed at the image data acquisition is described.

<First Method>

Figure 10:
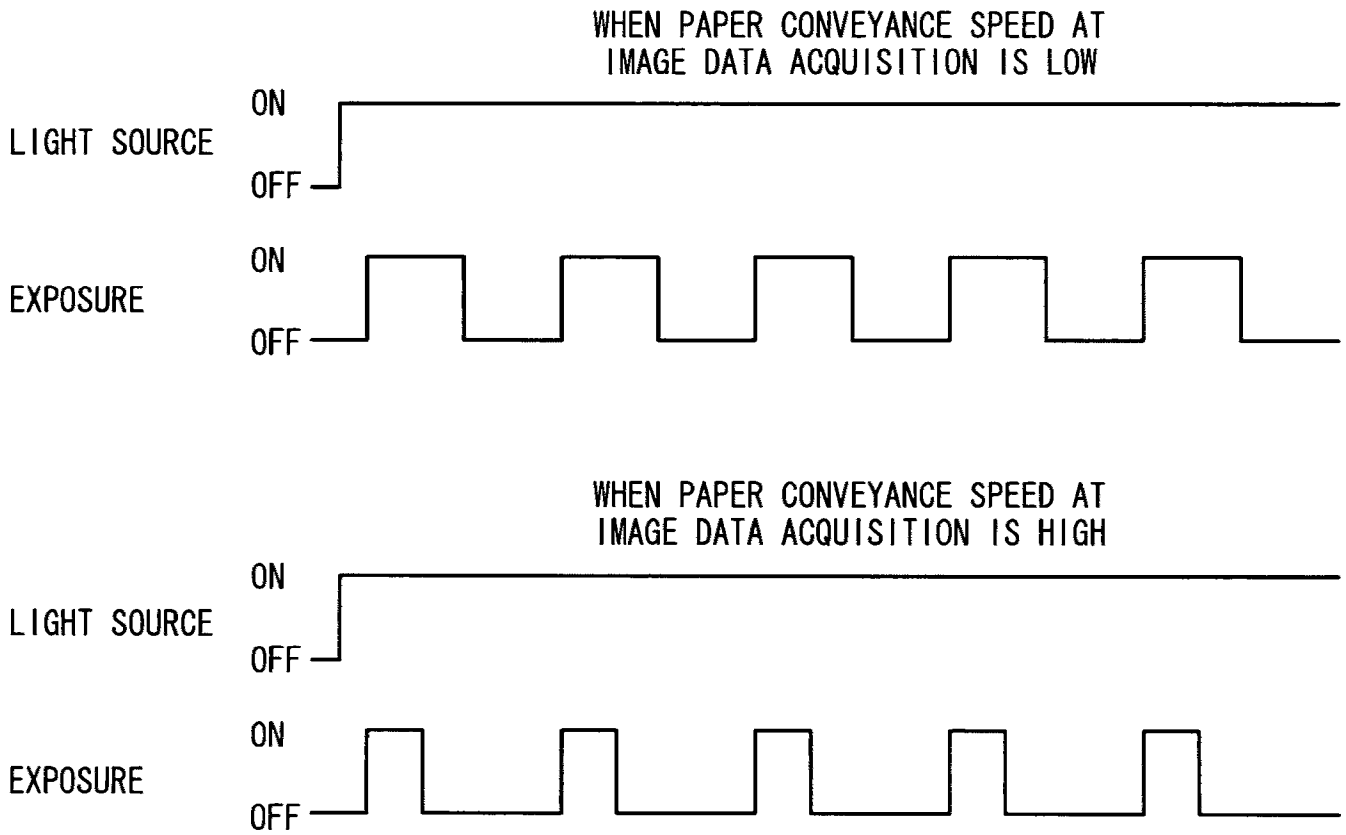
FIG. 10 is a timing chart showing the image data acquisition by means of a scanner.

In the first method, the acquisition duration (duration for acquiring one pixel) for which the image formed on the web 2 is read out is adjusted inversely proportional to the conveyance speed of the web 2 at the image data acquisition, and the variation in the acquired image data due to on the variation in the web conveyance speed at the image data acquisition is thereby prevented. More specifically, as shown in FIG. 10, the acquisition duration (exposure duration) is made shorter as the web conveyance speed at the image data acquisition becomes higher in order to prevent the image from being unfocused.

The information on the acquisition duration in accordance with the web conveyance speed at the image data acquisition is stored in the ROM. The system controller 100 reads out the information on the acquisition duration in accordance with the web conveyance speed at the image data acquisition from the ROM, and controls the fixing and reading controlling unit 122 to acquire the image data in accordance with the web conveyance speed at the image data acquisition.

Here, in the case where the speed of conveyance of the web 2 is extremely low, the output of the CCD is saturated when the acquisition duration is lengthened. Therefore, the acquisition duration is adjusted in accordance with the web conveyance speed at the image data acquisition only within such a range that the output of the CCD is not saturated. If the output of the CCD is to be saturated, the image data is acquired by setting the acquisition duration to a predetermined value in which the output of the CCD is not saturated, and a correction process is carried out on the acquired image data with the above-described correction function. Thus, the data of the image that is not unfocused can be acquired.

<Second Method>

In the second method, a strobe light source that can control the intensity of and duration for light emission (for example, an LED strobe) is used as the light source, and the intensity of and duration for light emission of the strobe light source are controlled in accordance with the conveyance speed of the web 2 at the image data acquisition.

Figure 11:
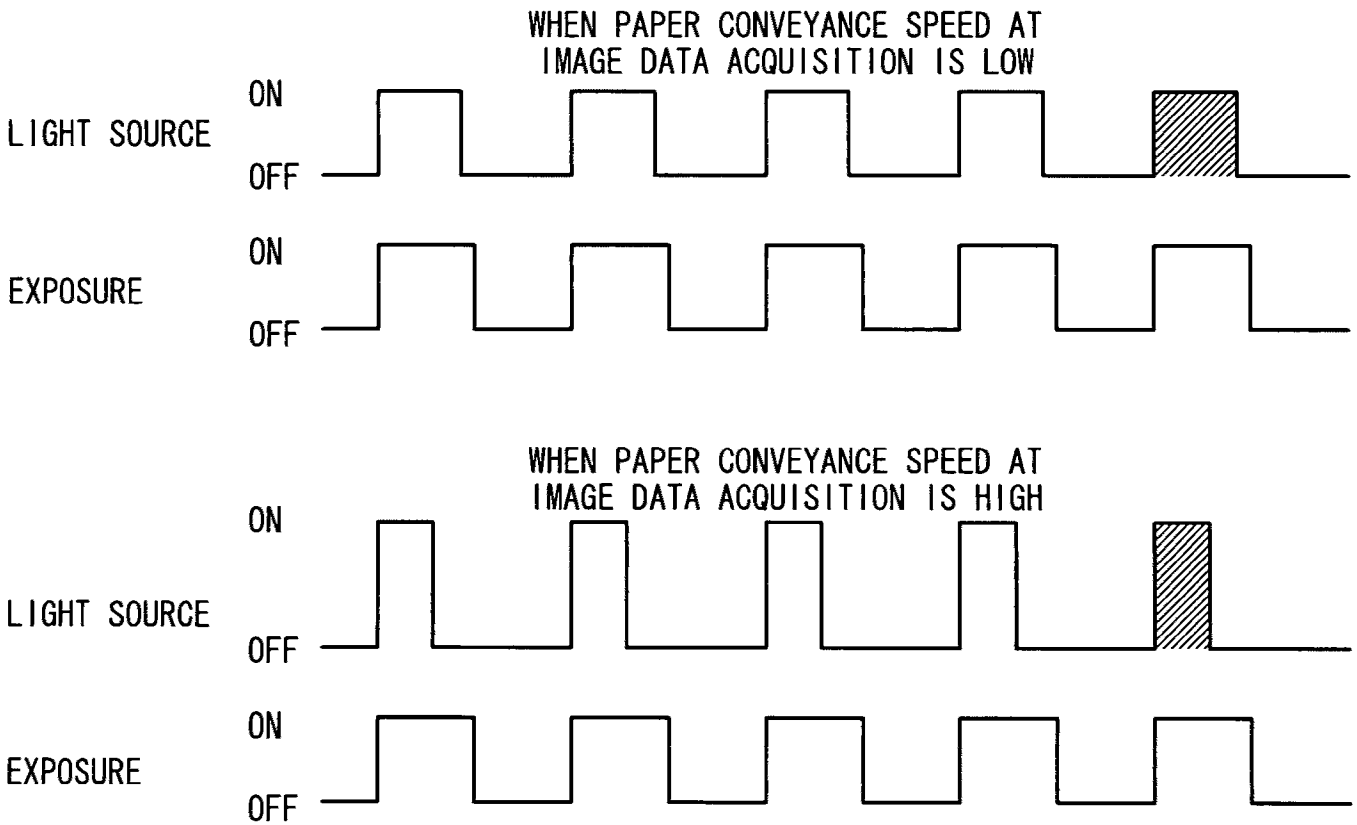
FIG. 11 is a timing chart showing the image data acquisition and light emission by means of a scanner.

More specifically, as shown in FIG. 11, the acquisition duration (exposure duration) is made constant and the light emission duration is adjusted inversely proportional to the web conveyance speed at the image data acquisition (the light emission duration is made shorter as the web conveyance speed at the image data acquisition becomes higher, and the maximum duration for the light emission is made shorter than the acquisition duration). Moreover, the intensity of the light emission is adjusted so that the value gained by integrating the amount of light for one emission becomes approximately constant (the area of the hutched area becomes constant).

The control information for the light source in accordance with the web conveyance speed at the image data acquisition is stored in the ROM. The system controller 100 reads out the control information for the light source in accordance with the web conveyance speed at the image data acquisition from the ROM, and controls the fixing and reading controlling unit 122 to emit light in accordance with the web conveyance speed at the image data acquisition.

<Third Method>

Figure 12:
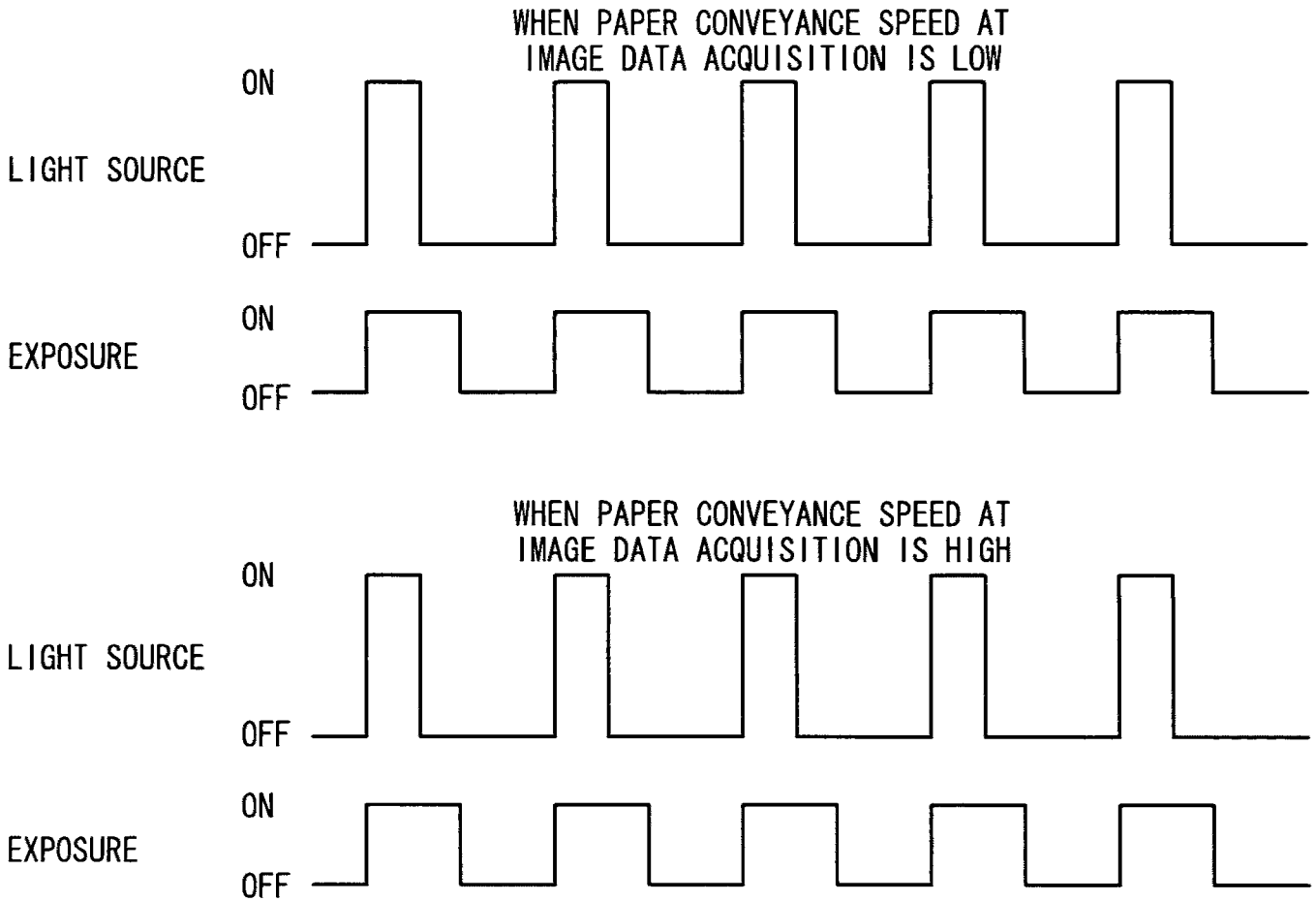
FIG. 12 is another timing chart showing the image data acquisition and light emission by means of a scanner.

In the third method, a strobe light source that can emit a large amount of strobe light is used as the light source so that light is emitted from the light source for a constant duration for light emission with a constant intensity of light emission as shown in FIG. 12, and thus the image data is acquired for the constant acquisition duration (exposure duration). More specifically, as shown in FIG. 12, light is emitted from the light source for the constant duration for light emission with the constant intensity of light emission irrelevant of the web conveyance speed at the image data acquisition, and thereby the image data is acquired for the constant acquisition duration. Here, the duration for light emission is set in such a manner that the amount by which the image formed on the web 2 moves is within one pixel in the case where the web conveyance speed at the image data acquisition is the maximum.

Light is emitted so that one pixel can be acquired when the web conveyance speed at the image data acquisition is maximum, and thus the data of the image that is not unfocused can be acquired.

Method for Measuring Web Conveyance Speed at Image Data Acquisition

In the case where the image data acquisition is controlled and the acquired image data is corrected in accordance with the web conveyance speed at the image data acquisition as described above, it is necessary to precisely know the web conveyance speed at the image data acquisition. Moreover, in the case where the acquired image data is analyzed, it is necessary to precisely know the web conveyance speed at the formation of the image of which the acquired image data is to be analyzed.

As described above, there is the method for finding the web conveyance speed at the image data acquisition from the rotation of the axis of the roller for conveying the web 2 by arranging the rotation measuring device, such as the rotary encoder, around the axis, and there is also the method for directly measuring the web conveyance speed at the image data acquisition using the laser Doppler speed meter.

According to these methods, the web conveyance speed at the image data acquisition can be directly measured, but the web conveyance speed at the image formation cannot be known. More specifically, in the inkjet printer 1 in the present embodiment, the dancer roller 62 is arranged between the printing unit 50 and the fixing and reading unit 70, and therefore the web conveyance speed at the image data acquisition is not necessarily the same as the web conveyance speed at the image formation, and it is possible for the web 2 to be conveyed at different speeds.

Hence, in the method described below, the web conveyance speeds at the formation of an image onto the web and at the data acquisition of the image formed on the web are measured.

Figure 13:
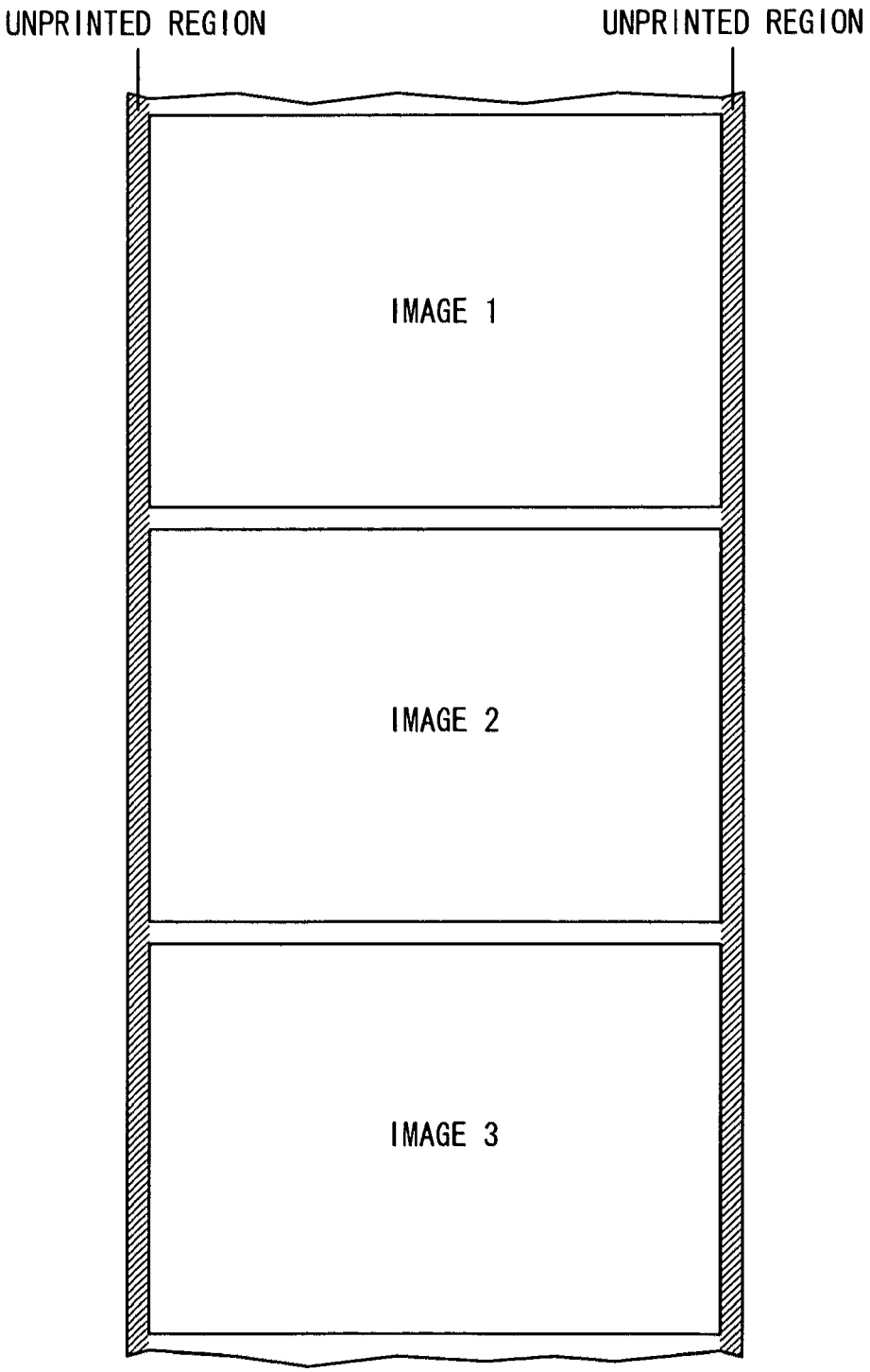
FIG. 13 is a diagram illustrating the printing on a web.

In general, in a case where images are printed on the web 2, as shown in FIG. 13, there are unprinted regions in the portions at the sides of the web 2 in the breadthways direction, and the area excluding these portions at the sides in the breadthways direction is set as a printed region.

Figure 14:
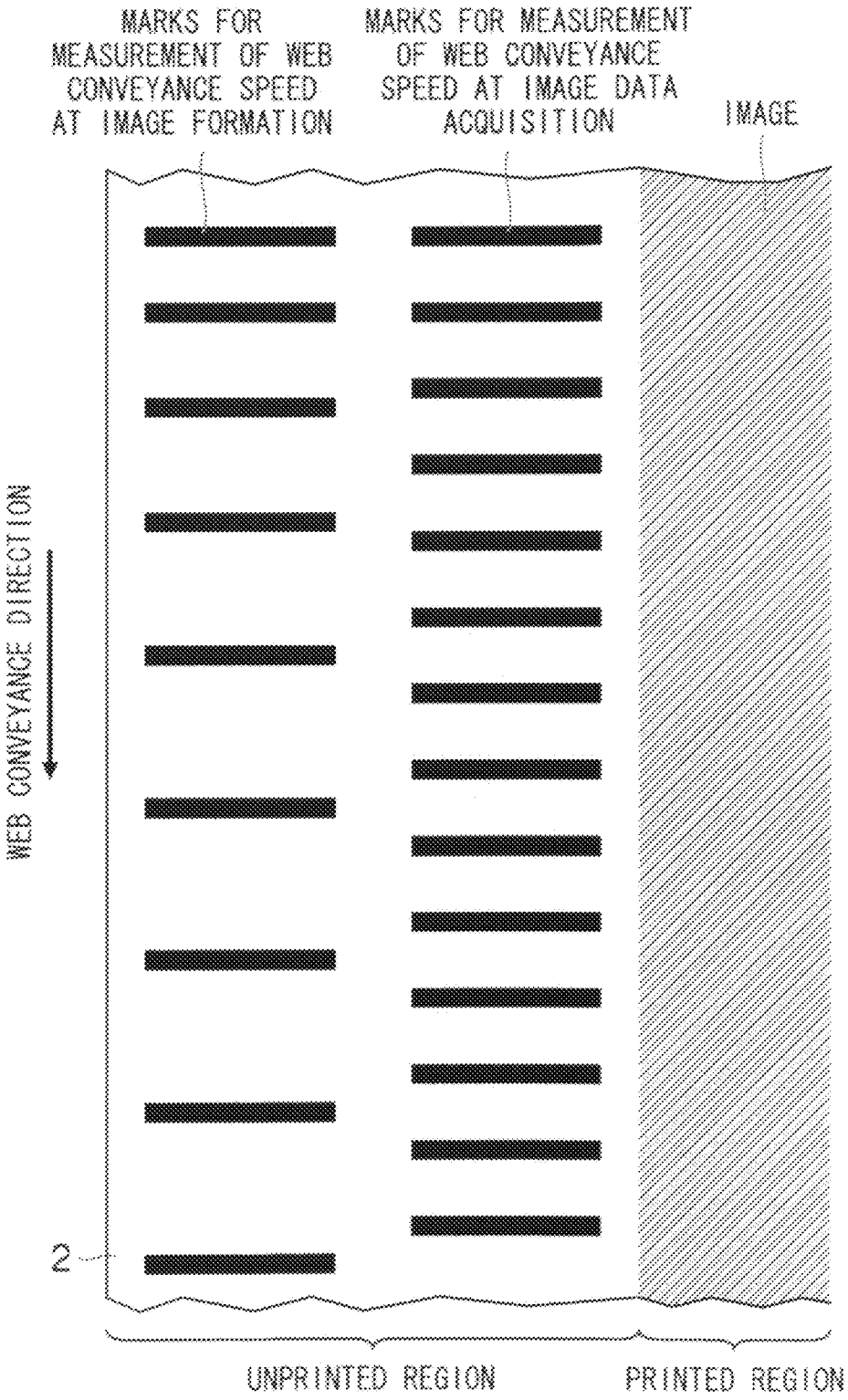
FIG. 14 is a diagram showing an arrangement of marks for measurement of the paper conveyance speed at the image formation and marks for measurement of the paper conveyance speed at the image data acquisition.

When the web 2 passes through the printing unit 50 directly below the inkjet heads, as shown in FIG. 14, predetermined marks for measurement of the web conveyance speed at the image data acquisition are formed at predetermined constant positional intervals (i.e., while controlling the mark formation in accordance with the web conveyance speed at the image formation) and predetermined marks for measurement of the web conveyance speed at the image formation are formed at predetermined constant temporal intervals in one of the unprinted regions.

The marks for measurement of the web conveyance speed at the image data acquisition and the marks for measurement of the web conveyance speed at the image formation are formed of line segments that are perpendicular to the conveyance direction of the web 2 (line segments perpendicular to the lengthwise direction of the web 2) as shown in FIG. 14 and are formed by any one of the inkjet heads for the ink colors of M, K, C and Y (for example, formed by the black inkjet head 51K).

In the fixing and reading unit 70, a speed measurement mark reading device (not shown) for reading the marks for measurement of the web conveyance speed at the image data acquisition and the marks for measurement of the web conveyance speed at the image formation is arranged close to the reading unit including the scanner 74. The speed measurement mark reading device measures the temporal intervals at which the marks for measurement of the web conveyance speed at the image data acquisition are read, and outputs the results of the measurement to the system controller 100. Moreover, the speed measurement mark reading device measures the positional intervals at which the marks for measurement of the web conveyance speed at the image formation are formed, and outputs the results of the measurement to the system controller 100.

The system controller 100 calculates the web conveyance speed at the image data acquisition and the web conveyance speed at the formation of the image that is being subjected to the image data acquisition by the scanner 74, from the temporal intervals at which the marks for measurement of the web conveyance speed at the image data acquisition are read, and the positional intervals at which the marks for measurement of the web conveyance speed at the image formation are arranged, which have been read out by the speed measurement mark reading device.

More specifically, the marks for measurement of the web conveyance speed at the image data acquisition are arranged sequentially onto the web 2 at the constant positional intervals (distances) irrelevant of the conveyance speed of the web 2 at the image formation (i.e., at the formation of the marks), and therefore the web conveyance speed at the image data acquisition can be found by measuring the temporal intervals at which the marks are read out.

On the other hand, the marks for measurement of the web conveyance speed at the image formation are arranged sequentially onto the web 2 at the constant temporal intervals (period), and therefore the web conveyance speed at the formation of the image that is being subjected to the image data acquisition by the scanner 74 can be found by measuring the positional intervals at which the marks are formed.

Thus, the web conveyance speed at the image data acquisition can be precisely measured, and at the same time the web conveyance speed at the formation of the image that is subjected to the image data acquisition can be known.

In the above-described embodiment, the marks for measurement of the web conveyance speed at the image data acquisition and the marks for measurement of the web conveyance speed at the image formation are arranged side-by-side in the one of the unprinted regions; however, it is also possible that the marks for measurement of the web conveyance speed at the image data acquisition are arranged in one of the unprinted regions, and the marks for measurement of the web conveyance speed at the image data acquisition are arranged in the other of the unprinted regions.

In the above-described embodiment, the marks for measurement of the web conveyance speed at the image data acquisition and the marks for measurement of the web conveyance speed at the image formation are formed by the inkjet head for forming the images in the printing unit 50 (the inkjet head 51K for ejecting black ink in the above described embodiment); however, it is also possible that the marks are formed by a separate dedicated image formation device (for example, an inkjet head different from the inkjet heads for forming the images in the printed region). In this case, it is possible to form both a set of the marks for measurement of the web conveyance speed at the image data acquisition and a set of the marks for measurement of the web conveyance speed at the image formation by the dedicated image formation device, or it is also possible to form only one of the sets by the dedicated image formation device and to form the other of the sets by the inkjet head for forming the images in the printing unit 50.

Moreover, the marks for measurement of the web conveyance speed at the image data acquisition are arranged at the constant positional intervals on the web 2, and therefore may be formed on the web 2 in advance. More specifically, images can be printed on the web 2 on which the marks for measurement of the web conveyance speed at the image data acquisition have been formed in advance. In this case, the printing unit can be provided with a device that reads the marks for measurement of the web conveyance speed at the image data acquisition so that the temporal intervals at which the marks are read are measured, and thus the conveyance speed of the web 2 can be measured in the printing unit as well.

The marks for measurement of the web conveyance speed at the image formation are formed at the constant temporal intervals, and therefore it is possible for the marks to overlap each other when the conveyance speed of the web 2 is very low.

Therefore, the marks for measurement of the web conveyance speed at the image formation are thinned out when the conveyance speed of the web 2 is so low that the marks are to overlap each other, and the web conveyance speed at the image formation is found while determining the state of the marks that have been thinned out when the speed is calculated. The state of the marks that have been thinned out can be determined as follows: for example, information on the number of the marks that have been thinned out is represented together with the marks for measurement of the web conveyance speed at the image formation, and the speed measurement mark reading device also reads the information.

Figure 15:
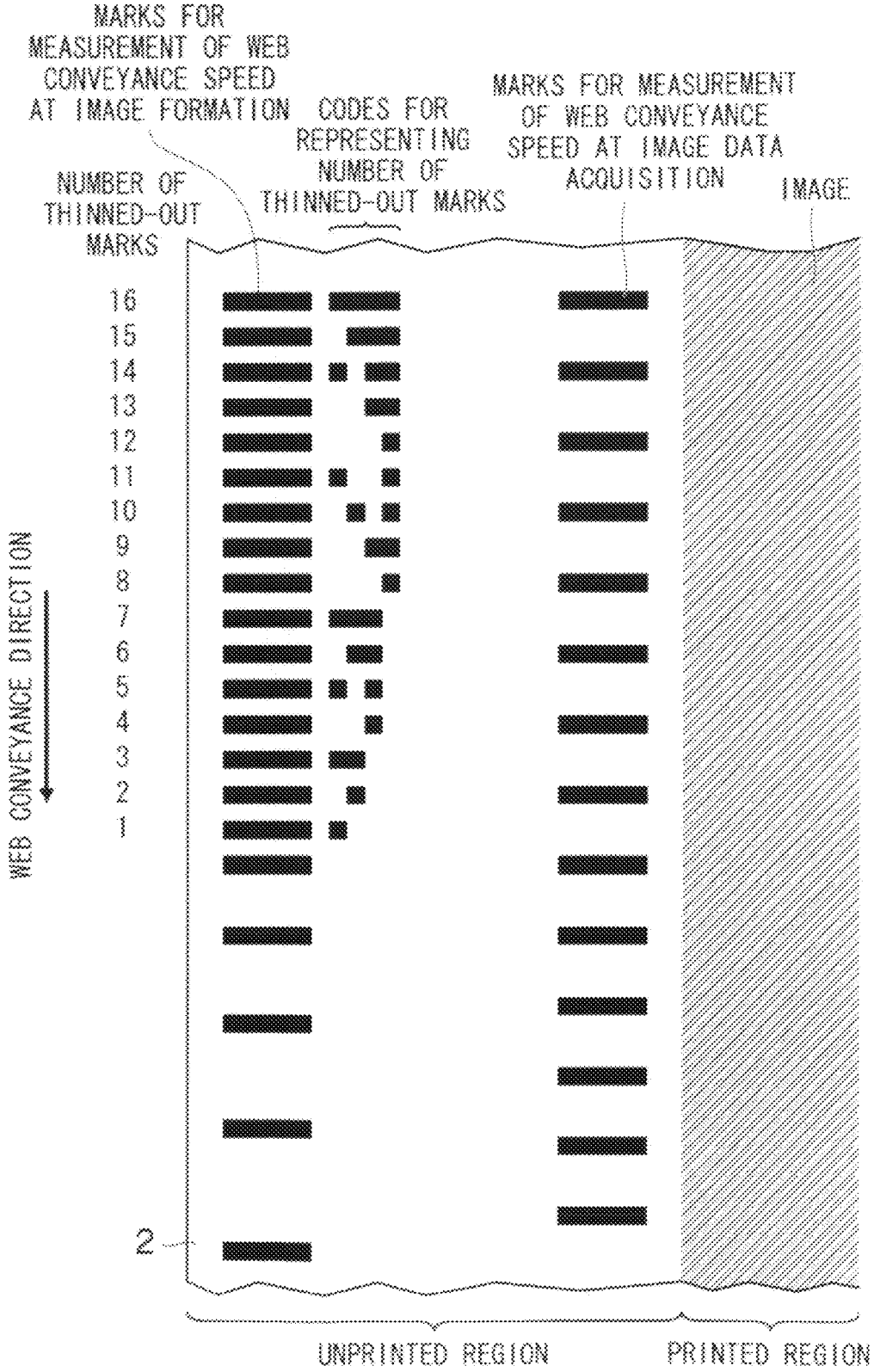
FIG. 15 is a diagram showing another arrangement of marks for measurement of the paper conveyance speed at the image formation and marks for measurement of the paper conveyance speed at the image data acquisition.

The information on the number of the marks that have been thinned out is coded as a dot pattern for describing the number of marks that have been thinned out as shown in FIG. 15, for example, and this pattern is formed together with the marks for measurement of the web conveyance speed at the image formation that are formed afterward. In the embodiment shown in FIG. 15, the number of marks that have been thinned out is coded in a pattern of four bits, and the pattern is arranged so as to be side-by-side with each of the marks for measurement of the web conveyance speed at the image formation. In this case, the marks can be thinned out by the maximum number of 16. The number of marks that have been thinned out can be represented by a known barcode or two-dimensional barcode which can be formed on the web.

In the above-described embodiment, the marks for measurement of the web conveyance speed at the image formation and the marks for measurement of the web conveyance speed at the image data acquisition are both the line segments perpendicular to the conveyance direction of the web 2; however, the forms of the marks for measurement of the web conveyance speed at the image formation and the marks for measurement of the web conveyance speed at the image data acquisition are not limited to this. The marks may be dots, lines or figures in specific forms instead of line segments.

It is also possible to add serial numbers to the marks for measurement of the web conveyance speed at the image formation and the marks for measurement of the web conveyance speed at the image data acquisition, and the information on the serial numbers can be represented together with the image. The information on the serial numbers is coded in dot patterns as described above and formed together with the marks for measurement of the web conveyance speed at the image formation and the marks for measurement of the web conveyance speed at the image data acquisition. Alternatively, the information on the serial numbers can be represented by known barcodes or two-dimensional barcodes which are formed together with the marks for measurement of the web conveyance speed at the image formation and the marks for measurement of the web conveyance speed at the image data acquisition.

Figure 16:
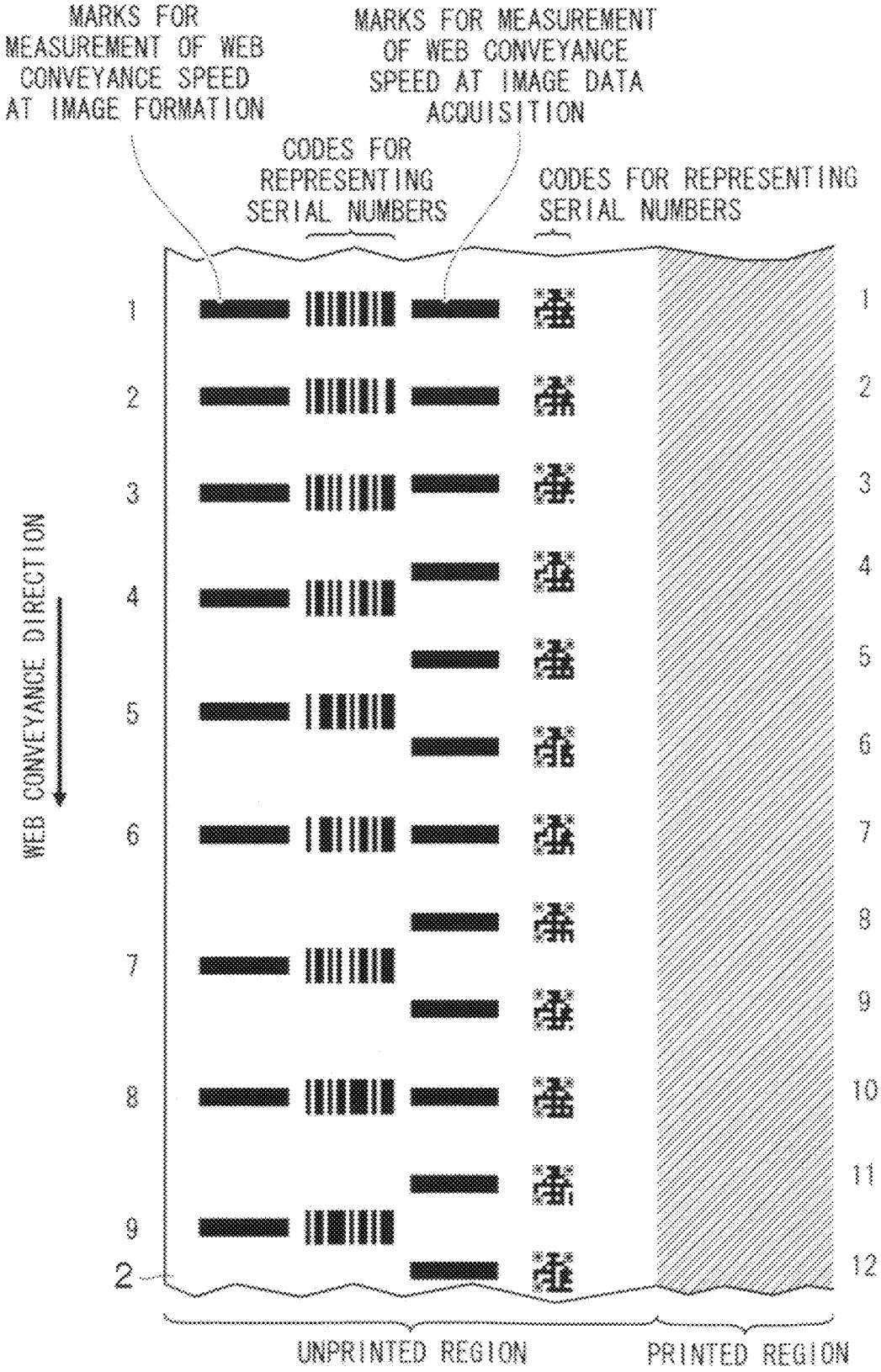
FIG. 16 is a diagram showing still another arrangement of marks for measurement of the paper conveyance speed at the image formation and marks for measurement of the paper conveyance speed at the image data acquisition.

FIG. 16 shows an embodiment where the serial numbers of the marks for measurement of the web conveyance speed at the image formation are represented in the barcodes, and the serial numbers of the marks for measurement of the web conveyance speed at the image data acquisition are represented in the two-dimensional barcodes.

In the embodiment shown in FIG. 16, the barcodes representing the serial numbers of the marks for measurement of the web conveyance speed at the image formation are arranged so as to be side-by-side with the marks for measurement of the web conveyance speed at the image formation, and the two-dimensional barcodes representing the serial numbers of the marks for measurement of the web conveyance speed at the image data acquisition are arranged so as to be side-by-side with the marks for measurement of the web conveyance speed at the image data acquisition; however, the positions where the information on the serial numbers is represented are not limited to these. The information can be represented in any other location close to the marks for measurement of the web conveyance speed at the image formation and the marks for measurement of the web conveyance speed at the image data acquisition, for example, above or below the marks.

Moreover, the patterns representing the information on the serial numbers of the marks can be contained in the marks as such. Furthermore, the patterns representing the information on the serial numbers of the marks can serve as the marks as such.

Figure 17:
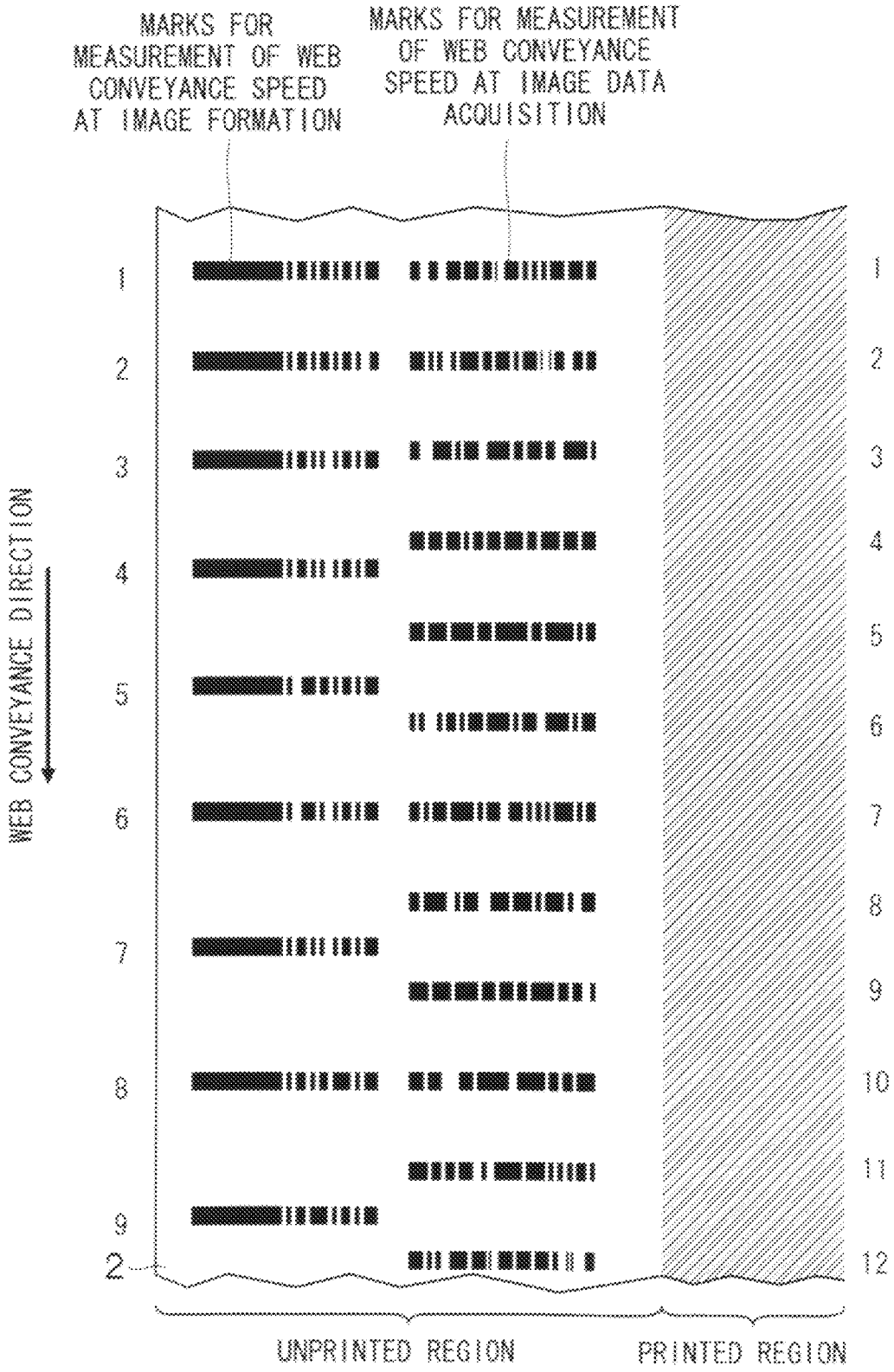
FIG. 17 is a diagram showing yet another arrangement of marks for measurement of the paper conveyance speed at the image formation and marks for measurement of the paper conveyance speed at the image data acquisition.

FIG. 17 shows an embodiment where the marks for measurement of the web conveyance speed at the image formation are partially the barcodes representing the serial numbers, and the marks for measurement of the web conveyance speed at the image data acquisition are themselves the barcodes representing the serial numbers.

Thus, the information representing the serial numbers is added to the marks for measurement of the web conveyance speed at the image formation and the marks for measurement of the web conveyance speed at the image data acquisition, and in the case where the marks are thinned out when being formed, for example, it is then possible to obtain the information on the number of the marks that have been thinned out, by acquiring the information on the serial numbers of the marks.

Other Methods for Measurement of Web Conveyance Speed at Image Formation

In the inkjet system, the state of interference between the ink droplets that have landed on the web changes when the temporal intervals of ejection vary.

Ink droplets are ejected and deposited in accordance with the conveyance of the web 2, and therefore the web conveyance speed at the image formation can be estimated by observing the state of interference between the ink droplets that have landed on the web 2.

Figure 18:
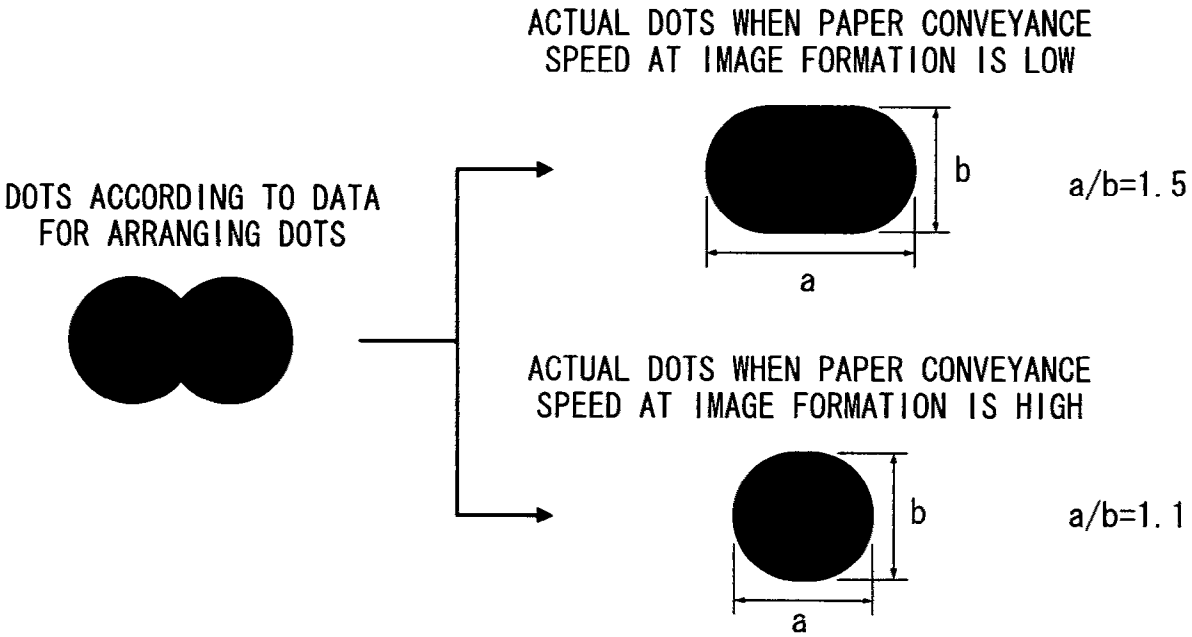
FIG. 18 is a diagram for illustrating a difference in interference between landing droplets due to a difference in the paper conveyance speed while the images are formed.

More specifically, as shown in FIG. 18, ink droplets which are deposited onto the web 2 so as to form dots adjacent to each other in the conveyance direction of the web 2 merge through the interference between the ink droplets upon landing on the web 2 so as to form one dot. In the case where the web conveyance speed at the image formation is low, the ink droplets land on the web 2 with a sufficient temporal interval therebetween, and therefore the dot on the web has such a form as to extend in the conveyance direction of the web 2. On the other hand, in the case where the web conveyance speed at the image formation is high, the temporal interval of ejection of the ink droplets is short, and therefore a second ink droplet lands on the first ink droplet so that the formed dot has a form close to that of a circle.

Accordingly, the web conveyance speed at the image formation can be estimated by measuring the form of the dot on the web.

The system controller 100 analyzes the image data acquired by the scanner 74, measures the form of the dot, and thereby estimates the web conveyance speed at the formation of the image of which the acquired image data is being analyzed.

For example, the form of the dot is measured as follows: the dot dimension a in the conveyance direction of the web 2 and the dot dimension b in the direction perpendicular to the conveyance direction of the web 2 are measured, and the ratio of the dimensions a and b (length-width ratio) is found. Then, the web conveyance speed at the image formation is estimated from this length-width ratio. More specifically, information on the web conveyance speed at the image formation corresponding to the length-width ratio of the dot dimensions is acquired in advance, and the web conveyance speed at the image formation is estimated in reference to this information. The information on the web conveyance speed at the image formation corresponding to the length-width ratio of the dot dimensions is stored in the ROM in the form of a function or a table so that it can be used by reading out from the ROM.

Here, the dot form may vary depending on the circumstances such as the type of paper (web) used, the state of the ink, the temperature and the humidity of the environment of the web, and an error in the landing of droplets, and therefore these pieces of information are taken into consideration when the web conveyance speed at the image formation is estimated from the dot form, and thus the speed can be estimated more precisely.

Other Embodiments

Although the above-described embodiments are cases where the present invention is applied to the printer for printing images onto continuous paper in band form (web) by means of the inkjet system, the application of the present invention is not limited to this, and the invention can be applied to printers for printing images onto sheets of paper by means of the inkjet system as well.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a paper conveying device which conveys paper;

a line-type inkjet head which performs image formation on the paper by ejecting ink droplets to the paper conveyed by the paper conveying device;

a paper conveyance speed measuring device which measures a paper conveyance speed of the paper at the image formation by the inkjet head;

a dot arrangement data acquiring device which acquires image data that includes an arrangement of dots in dot data to form an image by the inkjet head on the paper conveyed at a predetermined paper conveyance speed;

a dot arrangement data adjusting device which adjusts the image data for arranging the dots in the dot data by changing an arrangement of the dots in the dot data in accordance with the paper conveyance speed measured by the paper conveyance speed measuring device so that the image is formed on the paper with a constant image density on the paper even when the paper conveyance speed varies, to thereby prevent unevenness in image density due to variation in interference between deposited ink droplets on the paper; and a head drive controlling device which controls drive of the inkjet head in accordance with the adjusted data for arranging the dots, wherein the dot arrangement data adjusting device adjusts the image data for arranging dots in accordance with an adjustment information, the adjustment information being information for the image data for arranging dots for each paper conveyance speed, and wherein the adjustment information is information on a gradation curve which represents a relationship between a density of an input image and an appearance rate of dots for each paper conveyance speed.

2. The inkjet recording apparatus as defined in claim 1, further comprising:

an adjustment information storing device which stores the adjustment information.

3. The inkjet recording apparatus as defined in claim 1, wherein the gradation curve is set in such a manner that the appearance rate of dots of a small size increases as the paper conveyance speed increases, while the appearance rate of dots of a large size increases as the paper conveyance speed decreases.

4. The inkjet recording apparatus as defined in claim 1, wherein in a case where there is no information on the gradation curve corresponding to the paper conveyance speed measured by the paper conveyance speed measuring device, the dot arrangement data adjusting device adjusts the data for arranging dots in accordance with the information on the gradation curve corresponding to the paper conveyance speed near the measured paper conveyance speed.

5. The inkjet recording apparatus as defined in claim 1, wherein the dot arrangement data adjusting device adjusts the data for arranging dots for a region having an image density which is not lower than a predetermined value.

6. The inkjet recording apparatus as defined in claim 1, wherein the dot arrangement data adjusting device adjusts the data for arranging dots for a region where the dots are arranged adjacently to each other.

7. The inkjet recording apparatus as defined in claim 6, wherein the dot arrangement data adjusting device adjusts the data for arranging dots for the region where the dots are arranged so as to surround one dot by four or eight adjacent dots that are arranged above, below, right and left of the one dot.

8. The inkjet recording apparatus as defined in claim 1, wherein the dot arrangement data adjusting device adjusts the data for arranging dots in accordance with an average paper conveyance speed in a case where a variation in the paper conveyance speed when one image is formed is not larger than a first threshold value.

9. The inkjet recording apparatus as defined in claim 8, wherein the dot arrangement data adjusting device adjusts the data for arranging dots in accordance with an average paper conveyance speed for a plurality of images in a case where a variation in the paper conveyance speed when one image is formed is not larger than a second threshold value smaller than the first threshold value.

10. The inkjet recording apparatus as defined in claim 1, wherein:

the paper is continuous paper in band form; and the paper conveying device feeds out the paper that is wound on a core in a roll, makes the paper run through a predetermined conveyance path, and winds up the paper on a core in a roll.

11. An inkjet recording apparatus, comprising:

a paper conveying device which conveys paper;

a line-type inkjet head which performs image formation on the paper by ejecting ink droplets to the paper conveyed by the paper conveying device;

a paper conveyance speed measuring device which measures a paper conveyance speed of the paper at the image formation by the inkjet head;

a dot arrangement data acquiring device which acquires data for arranging dots to form an image by the inkjet head on the paper conveyed at a predetermined paper conveyance speed;

an ejection amount information storing device which stores information on an ejection amount of ink per dot when an image is formed on the paper conveyed at a predetermined paper conveyance speed;

an adjustment information storing device which stores, for each paper conveyance speed, adjustment information for the ejection amount used to form an image with a constant image density on the paper even when the paper conveyance speed varies;

an ejection amount adjusting device which adjusts the ejection amount in accordance with the paper conveyance speed measured by the paper conveyance speed measuring device; and a head drive controlling device which controls drive of the inkjet head in accordance with the information on the adjusted ejection amount and the data for arranging dots, and wherein in a case where there is no adjustment information for the ejection amount corresponding to the paper conveyance speed measured by the paper conveyance speed measuring device, the ejection amount adjusting device adjusts the ejection amount in accordance with the adjustment information for the ejection amount corresponding to the paper conveyance speed near the measured paper conveyance speed.

12. An inkjet recording apparatus, comprising:

a paper conveying device which conveys paper;

a line-type inkjet head which performs image formation on the paper by ejecting ink droplets to the paper conveyed by the paper conveying device;

a paper conveyance speed measuring device which measures a paper conveyance speed of the paper at the image formation by the inkjet head;

a dot arrangement data acquiring device which acquires data for arranging dots to form an image by the inkjet head on the paper conveyed at a predetermined paper conveyance speed;

an ejection amount information storing device which stores information on an ejection amount of ink per dot when an image is formed on the paper conveyed at a predetermined paper conveyance speed;

an adjustment information storing device which stores, for each paper conveyance speed, adjustment information for the ejection amount used to form an image with a constant image density on the paper even when the paper conveyance speed varies;

an ejection amount adjusting device which adjusts the ejection amount in accordance with the paper conveyance speed measured by the paper conveyance speed measuring device; and a head drive controlling device which controls drive of the inkjet head in accordance with the information on the adjusted ejection amount and the data for arranging dots, and wherein the ejection amount adjusting device adjusts the ejection amount in accordance with an average paper conveyance speed in a case where a variation in the paper conveyance speed when one image is formed is not larger than a first threshold value.

13. The inkjet recording apparatus as defined in claim 12, wherein the ejection amount adjusting device adjusts the ejection amount in accordance with an average paper conveyance speed for a plurality of images in a case where a variation in the paper conveyance speed when one image is formed is not larger than a second threshold value smaller than the first threshold value.

14. An inkjet recording method of performing image formation on running paper by ejecting ink droplets to the paper from a line-type inkjet head, the method comprising the steps of:

acquiring in advance adjustment conditions for adjusting image data that includes an arrangement of dots in dot data, the adjustment conditions being used to correct a variation in image density on the paper occurring in an image formed on the paper when the paper runs at a speed other than a predetermined speed, to thereby prevent unevenness in image density due to variation in interference between deposited ink droplets on the paper;

adjusting the image data for arranging the dots in the dot data for an image to be formed, by changing an arrangement of the dots in the dot data in accordance with the adjustment conditions in a case where the paper runs at a speed other than the predetermined speed;

driving the inkjet head in accordance with the adjusted data for arranging the dots; and forming the image on the paper, wherein the adjusting step adjusts the image data for arranging dots in accordance with an adjustment information, the adjustment information being information for the image data for arranging dots for each paper conveyance speed, and wherein the adjustment information is information on a gradation curve which represents a relationship between a density of an input image and an appearance rate of dots for each paper conveyance speed.

15. The inkjet recording method as defined in claim 14, wherein the paper is continuous paper in band form.

* * * * *